US008793873B2

(12) United States Patent
Fielder et al.

(10) Patent No.: US 8,793,873 B2
(45) Date of Patent: Aug. 5, 2014

(54) METHOD OF PROVIDING PRINTHEAD ASSEMBLY HAVING COMPLEMENTARY HYDROPHILIC AND HYDROPHOBIC SURFACES

(75) Inventors: Simon Fielder, Balmain (AU); Lewis Matich, Balmain (AU); Kia Silverbrook, Balmain (AU); Gregory John McAvoy, Dublin (IE); Rónán Pádraig Seán O'Reilly, Dublin (IE); Emma Rose Kerr, Dublin (IE)

(73) Assignee: Memjet Technology Ltd., Dublin (IE)

( * ) Notice: Subject to any disclaimer, the term of this patent is extended or adjusted under 35 U.S.C. 154(b) by 814 days.

(21) Appl. No.: 12/906,135

(22) Filed: Oct. 18, 2010

(65) Prior Publication Data

US 2011/0298869 A1 Dec. 8, 2011

Related U.S. Application Data

(63) Continuation-in-part of application No. 12/794,777, filed on Jun. 7, 2010.

(51) Int. Cl.
*B41J 2/145* (2006.01)
*B41J 2/16* (2006.01)

(52) U.S. Cl.
USPC ..... 29/890.1; 347/45; 347/47; 427/203; 427/372.2

(58) Field of Classification Search
USPC ..... 347/20, 44, 45, 46, 47; 29/890.1, 830; 216/105, 106; 205/214; 427/372.2, 203
See application file for complete search history.

(56) References Cited

U.S. PATENT DOCUMENTS

| | | | | |
|---|---|---|---|---|
| 3,779,842 | A * | 12/1973 | Grunwald et al. | 216/106 |
| 6,302,523 | B1 * | 10/2001 | Smith et al. | 347/45 |
| 6,494,566 | B1 * | 12/2002 | Kishino et al. | 29/890.1 X |
| 6,955,834 | B2 * | 10/2005 | Rohrbaugh et al. | 427/372.2 X |
| 7,275,310 | B2 * | 10/2007 | Suzuki | 29/890.1 X |
| 2005/0084612 | A1 | 4/2005 | Yang et al. | |
| 2005/0085404 | A1 | 4/2005 | Yoneda et al. | |
| 2005/0200669 | A1 | 9/2005 | Timm et al. | |
| 2007/0120889 | A1 * | 5/2007 | Kang et al. | 347/45 |
| 2009/0084683 | A1 * | 4/2009 | Campestrini et al. | 205/214 |

FOREIGN PATENT DOCUMENTS

| | | | | |
|---|---|---|---|---|
| JP | 06143588 | A * | 5/1994 | 347/47 X |
| JP | 2009039911 | A | 2/2009 | |

* cited by examiner

*Primary Examiner* — A. Dexter Tugbang
(74) *Attorney, Agent, or Firm* — Cooley LLP

(57) ABSTRACT

A method of providing a printhead assembly having a hydrophilic ink pathway and a hydrophobic ink ejection face. The method includes the steps of: providing a printhead assembly comprising a printhead attached to an ink supply manifold, the printhead comprising a nozzle plate having a hydrophobic coating and a protective metal film disposed on the hydrophobic coating; treating surfaces of an ink pathway in the printhead assembly with a solution comprising an alkoxylated polyethyleneimine; drying the surfaces; and removing the protective metal film so as to reveal the hydrophobic coating.

18 Claims, 18 Drawing Sheets

METHOD OF PROVIDING PRINTHEAD ASSEMBLY HAVING COMPLEMENTARY HYDROPHILIC AND HYDROPHOBIC SURFACES

CROSS REFERENCE TO RELATED APPLICATIONS

This application is a continuation-in-part of U.S. application Ser. No. 12/794,777 filed Jun. 7, 2010, all of which is herein incorporated by reference.

FIELD OF INVENTION

The disclosed invention relates to a method for hydrophilizing surfaces of a printhead assembly. It has been developed primarily for improving priming and print quality in inkjet printheads, particularly pagewidth inkjet printheads.

CO-PENDING APPLICATIONS

The following applications have been filed by the Applicant simultaneously with the present application:

| | |
|---|---|
| SBF041US | SBF042US |

The disclosures of these co-pending applications are incorporated herein by reference. The above applications have been identified by their filing docket number, which will be substituted with the corresponding application number, once assigned.

CROSS REFERENCES TO RELATED APPLICATIONS

Various methods, systems and apparatus relating to the present invention are disclosed in the following US patents/patent applications filed by the applicant or assignee of the present invention:

| | | | | | | |
|---|---|---|---|---|---|---|
| 7,344,226 | 7,328,976 | 11/685,084 | 11/685,086 | 11/685,090 | 11/740,925 | 11/763,444 |
| 11/763,443 | 11/946,840 | 11/961,712 | 12/017,771 | 7,367,648 | 7,370,936 | 7,401,886 |
| 11/246,708 | 7,401,887 | 7,384,119 | 7,401,888 | 7,387,358 | 7,413,281 | 11/482,958 |
| 11/482,955 | 11/482,962 | 11/482,963 | 11/482,956 | 11/482,954 | 11/482,974 | 11/482,957 |
| 11/482,987 | 11/482,959 | 11/482,960 | 11/482,961 | 11/482,964 | 11/482,965 | 11/482,976 |
| 11/482,973 | 11/495,815 | 11/495,816 | 11/495,817 | 60,992,635 | 60,992,637 | 60,992,641 |
| 12/050,078 | 12/050,066 | 12/138,376 | 12/138,373 | 12/142,774 | 12/140,192 | 12/140,264 |
| 12/140,270 | 11/607,976 | 11/607,975 | 11/607,999 | 11/607,980 | 11/607,979 | 11/607,978 |
| 11/735,961 | 11/685,074 | 11/696,126 | 11/696,144 | 7,384,131 | 11/763,446 | 6,665,094 |
| 7,416,280 | 7,175,774 | 7,404,625 | 7,350,903 | 11/293,832 | 12/142,779 | 11/124,158 |
| 6,238,115 | 6,390,605 | 6,322,195 | 6,612,110 | 6,480,089 | 6,460,778 | 6,305,788 |
| 6,426,014 | 6,364,453 | 6,457,795 | 6,315,399 | 6,755,509 | 11/763,440 | 11/763,442 |
| 12/114,826 | 12/114,827 | 12/239,814 | 12/239,815 | 12/239,816 | 11/246,687 | 7,156,508 |
| 7,303,930 | 7,246,886 | 7,128,400 | 7,108,355 | 6,987,573 | 10/727,181 | 6,795,215 |
| 7,407,247 | 7,374,266 | 6,924,907 | 11/544,764 | 11/293,804 | 11/293,794 | 11/293,828 |
| 11/872,714 | 10/760,254 | 7,261,400 | 11/583,874 | 11/782,590 | 11/014,764 | 11/014,769 |
| 11/293,820 | 11/688,863 | 12/014,767 | 12/014,768 | 12/014,769 | 12/014,770 | 12/014,771 |
| 12/014,772 | 11/482,982 | 11/482,983 | 11/482,984 | 11/495,818 | 11/495,819 | 12/062,514 |
| 12/192,116 | 7,306,320 | 10/760,180 | 6,364,451 | 7,093,494 | 6,454,482 | 7,377,635 |
| 12/323,471 | 12/014,772 | 7,401,886 | 7,530,663 | 11/495,815 | 12/794,777 | |

BACKGROUND OF THE INVENTION

The present Applicant has previously described printhead assemblies, which include a printhead (usually comprised of one or more printhead integrated circuits) and an ink supply manifold for supplying ink to the printhead. The printhead may be bonded to the ink supply manifold with an adhesive film. The printhead, the ink supply manifold and the adhesive film define ink pathways for supplying ink to nozzle openings defined in an ink ejection face of the printhead.

It is generally desirable for ink pathways to have hydrophilic surfaces. Hydrophilic surfaces improve printhead priming as well as print quality. During the operation of conventional printhead assemblies, there has been observed a phenomenon where bubbles form on the surfaces of the ink paths as ink flows therethrough. The formation of such bubbles causes blockages in the ink flow, reduces the wettability of the surfaces, and degrades print quality.

To ameliorate this problem, the surfaces of a printhead assembly may be activated with a plasma species during or after fabrication. Plasma activation of the internal surfaces of the printhead assembly renders these surfaces more hydrophilic and increases their wettability; this in turn inhibits bubble formation.

The hydrophilic characteristics conveyed to surfaces by plasma activation, however, degrade or relax with time. In the case of printhead assemblies, one solution for ameliorating this problem is to prime the printhead assemblies with ink, or an ink like fluid, after the surfaces of ink paths have been plasma activated, and to ensure that the printhead assemblies remain primed with ink (or the ink like fluid) until they are used. Keeping a printhead assembly primed with ink, or an ink like fluid, from the time of production until the time of use, however, introduces significant complexities, including the storage and transport of such primed printhead assemblies.

Sheu et al (*Polymer Surface and Interfaces: Characterization, Modification and Application,* 1997, pp 83-90) describe treatment of plasma activated surfaces with a polyethyleneimine (PEI) solution in order to retard relaxation of the plasma activated surface. According to the current understanding in the art, PEI relies predominantly on interactions with carboxylate groups on the activated surfaces. PEI is therefore understood to be less effective when used on surfaces activated with a plasma other than a carbon dioxide plasma.

U.S. Pat. No. 5,700,559, U.S. Pat. No. 5,807,636, and U.S. Pat. No. 5,837,377 describe a hydrophilic article for use in aqueous environments, including a substrate, an ionic polymeric layer on the substrate, and a disordered polyelectrolyte coating ionically bonded to the polymeric layer.

The plasma activation of a printhead assembly is conventionally performed using a vacuum plasma processing method. Vacuum plasma processing methods, however, are expensive and time consuming. A vacuum plasma processing method requires costly and specialised equipment to create a vacuum and to generate a plasma within the vacuum. Further, significant time is required for loading and unloading a work piece into/from a vacuum chamber, creating and releasing the vacuum, and allowing the plasma to diffused through and activate the work piece.

A further disadvantage associated with vacuum plasma processing is that vacuum plasma processing is indiscriminate insofar as which surfaces of the work piece are activated, and to what extent they are activated. Directed activation of specific surfaces is generally difficult to achieve and the selective activation of internal surfaces alone is impossible.

Still further, the vacuum plasma processing method does not complement serial/assembly-line type production process commonly used in the fabrication of printhead assemblies. To enable the vacuum plasma process to be cost feasible, printhead assemblies are processed in batches. The collation and later de-collation of printhead assemblies into batches for vacuum plasma processing interrupts the work flow of serial, assembly-line type production processes and reduces the efficiency of the production process.

Quality control issues also arise from the discontinuity caused by the batch processing of printhead assemblies for vacuum plasma processing. A first printhead assembly removed from a vacuum processing batch and a last printhead assembly removed from the same batch vary in age. For example, a printhead assembly removed first from the batch exiting the vacuum plasma process has an active surface that is "younger" than a printhead assembly removed last from the same batch. Such differences in age affect the results of further processing steps performed downstream of the vacuum plasma processing step.

Accordingly, it would be desirable to provide a method for hydrophilizing surfaces of ink paths in printheads and/or printhead assemblies.

SUMMARY OF INVENTION

In a first aspect, there is provided a method of hydrophilizing one or more surfaces of an ink pathway configured for supplying ink to nozzles in an inkjet printhead, the method comprising steps of:

treating the surfaces of the ink pathway with a solution comprising an alkoxylated polyethyleneimine; and drying the surfaces.

Optionally, the surfaces of the ink pathway are comprised of at least one of: silicon, silicon oxide, silicon nitride and one or more polymers.

Optionally, the one or more polymers are selected from the group consisting of: liquid crystal polymers, polyimides, polysulfones, epoxy resins, polyolefins and polyesters.

Optionally, the ink pathway is defined in at least one of:

the inkjet printhead;

an ink supply manifold; and an adhesive film bonding the printhead to the ink supply manifold.

Optionally, the inkjet printhead comprises nozzle chambers and ink supply channels defining at least part of the ink pathway.

Optionally, the inkjet printhead is comprised of one or more printhead integrated circuits.

Optionally, the method further comprises the step of:

baking the surfaces of the ink pathway.

Optionally, the baking step is performed at a temperature in the range of 40 to 100° C.

Optionally, the drying step includes the baking step.

Optionally, the method further comprises the step of:

plasma activating the surfaces of the ink pathway before treating the surfaces.

Optionally, the surfaces are activated using an oxygen plasma (i.e. a plasma comprising oxygen or consisting of oxygen). However, the surfaces may be activated using other plasmas, such as carbon dioxide, helium or argon plasmas, as well as combinations of oxygen, carbon dioxide, helium and argon plasmas.

Optionally, the surfaces are activated using a plasma at atmospheric pressure.

Optionally, the surfaces of the ink pathway are not activated by a plasma before treatment.

Optionally, the alkoxylated polyethyleneimine is a polyethyleneimine having one or more primary and/or secondary amine groups functionalized with a moiety of formula (A):

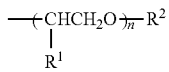

(A)

wherein:

$R^1$ is selected from the group consisting of: H and $C_{1-6}$ alkyl;

$R^2$ is selected from the group consisting of: H, $C_{1-6}$ alkyl and C(O)—$C_{1-6}$ alkyl; and n is an integer from 1 to 50.

Preferably $R^2$ is H. Preferably, $R^1$ is H or methyl; more preferably $R^1$ is H. Preferably n is from 1 to 10; more preferably n is 1.

Optionally, the alkoxylated polyethyleneimine is from 1 to 99% alkoxylated (optionally from 40% to 90% alkoxylated).

Optionally, the alkoxylated polyethyleneimine has a molecular weight of from 300 to 1,000,000 (optionally from 1000 to 200,000).

Optionally, the alkoxylated polyethyleneimine is selected from the group consisting of: ethoxylated polyethyleneimine and propoxylated polyethyleneimine.

Optionally, the solution further comprises one or more components selected from the group consisting of: $C_{1-6}$ alcohol, ($C_{2-6}$ alkylene) glycol, poly($C_{2-6}$ alkylene) glycol, water and at least one surfactant.

Optionally, the method further comprises the step of assembling the printhead into a printhead cartridge.

Optionally, the method further comprises the step of performing a print quality and/or electrical test on the printhead.

Optionally, the step of drying the ink pathway comprises passing air through the ink pathway.

In a second aspect, there is provided an inkjet printhead or a printhead assembly comprising ink pathways with hydrophilic surfaces, which is obtained or which is obtainable by the method described above.

In a third aspect, there is provided an inkjet printhead comprising a hydrophilic ink pathway, wherein one or more surfaces of the ink pathway comprise a layer of an alkoxylated polyethyleneimine. The alkoxylated polyethyleneimine film which lines one or more surfaces of the ink pathways provides a highly robust hydrophilic layer, which improves both printhead priming and print quality.

Optionally, the alkoxylated polyethyleneimine is bound to the surfaces by at least one of: ionic interactions and hydrogen bonding.

Optionally, the surfaces of the ink pathway are comprised of at least one of: silicon, silicon oxide and silicon nitride.

Optionally, nozzle chambers and ink supply channels define at least part of the hydrophilic ink pathway.

Optionally, the surfaces of the ink pathway comprise a plurality of oxyanionic groups and/or hydroxyl groups for interacting with the alkoxylated polyethyleneimine.

Optionally, the oxyanionic groups and/or hydroxyl groups are generated by plasma activation of the surfaces.

Optionally, the printhead comprises a nozzle plate having a hydrophobic coating disposed thereon.

Optionally, the hydrophobic coating comprises a polymer layer.

Optionally, the printhead is comprised of one or more printhead integrated circuits.

Optionally, the printhead is comprised of a plurality of printhead integrated circuits butted end-on-end to define the printhead In a fourth aspect, there is provided a printhead assembly comprising a hydrophilic ink pathway, wherein one or more surfaces of the ink pathway comprise a layer of an alkoxylated polyethyleneimine.

Optionally, the printhead assembly comprises an inkjet printhead bonded to an ink supply manifold, the hydrophilic ink pathway extending between the ink supply manifold and the printhead.

Optionally, an adhesive film is sandwiched between the printhead and the ink supply manifold.

Optionally, the surfaces of the ink pathway in the printhead assembly are comprised of at least one of: silicon, silicon oxide, silicon nitride and one or more polymers.

Optionally, the one or more polymers are selected from the group consisting of: liquid crystal polymers, polyimides, polysulfones, epoxy resins, polyolefins and polyesters.

In a fifth aspect, there is provided an ink supply manifold for an inkjet printhead, the ink supply manifold comprising a hydrophilic ink pathway, wherein one or more surfaces of the ink pathway comprise a layer of an alkoxylated polyethyleneimine.

In a sixth aspect, there is provided a method of providing a printhead assembly having a hydrophilic ink pathway and a hydrophobic ink ejection face, the method comprising the steps of:

providing a printhead assembly having an inkjet printhead attached to an ink supply manifold, the printhead comprising a nozzle plate having a hydrophobic coating and a protective metal film disposed on the hydrophobic coating;

treating the surfaces of an ink pathway in the printhead assembly with a solution comprising an alkoxylated polyethyleneimine;

drying the surfaces; and removing the protective metal film so as to reveal the hydrophobic coating, and thereby provide the printhead assembly having the hydrophilic ink pathway and the hydrophobic ink ejection face.

Optionally, the protective metal film is an aluminum film or a titanium film.

Optionally, the hydrophobic coating comprises a polymerized siloxane.

Optionally, the method further comprises the step of:

plasma activating the surfaces of the ink pathway before treating the surfaces with the solution comprising the alkoxylated polyethyleneimine.

Optionally, the step of removing the metal film uses a basic etchant solution, preferably a solution of a quaternary ammonium hydroxide, such as a tetra($C_{1-6}$ alkyl)ammonium hydroxide e.g. TMAH.

In a seventh aspect, there is provided a method of providing a printhead having a hydrophilic ink pathway and a hydrophobic ink ejection face, the method comprising the steps of:

providing a printhead comprising a nozzle plate having a hydrophobic coating and a protective metal film disposed on the hydrophobic coating;

treating the surfaces of an ink pathway in the printhead with a solution comprising an alkoxylated polyethyleneimine;

drying the surfaces; and removing the protective metal film so as to reveal the hydrophobic coating, and thereby provide the printhead having the hydrophilic ink pathway and the hydrophobic ink ejection face.

DETAILED DESCRIPTION

Ink Pathways in Inkjet Printheads and Printhead Assemblies

Figure 1:
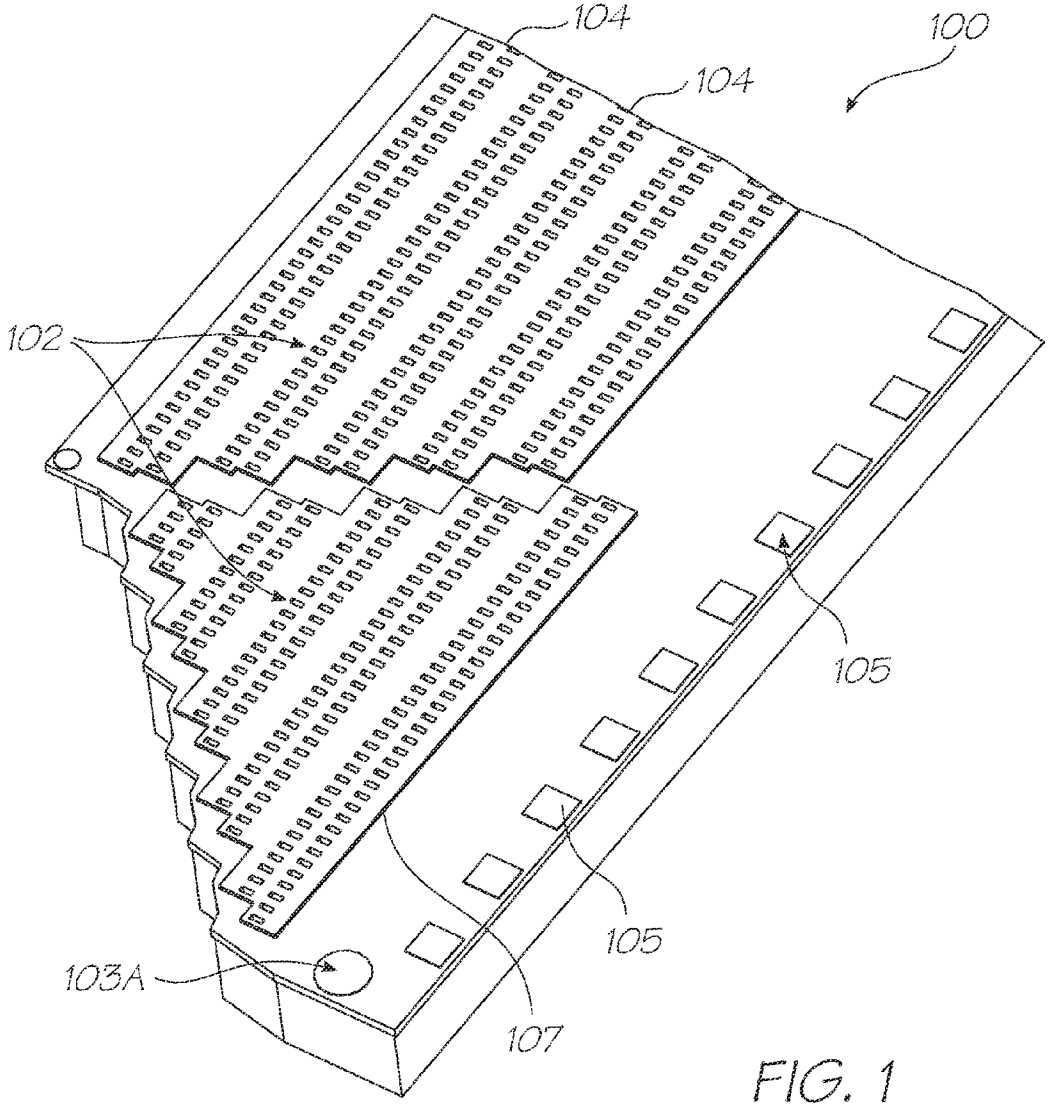
FIG. 1 is a front perspective of a printhead integrated circuit.
Figure 2:
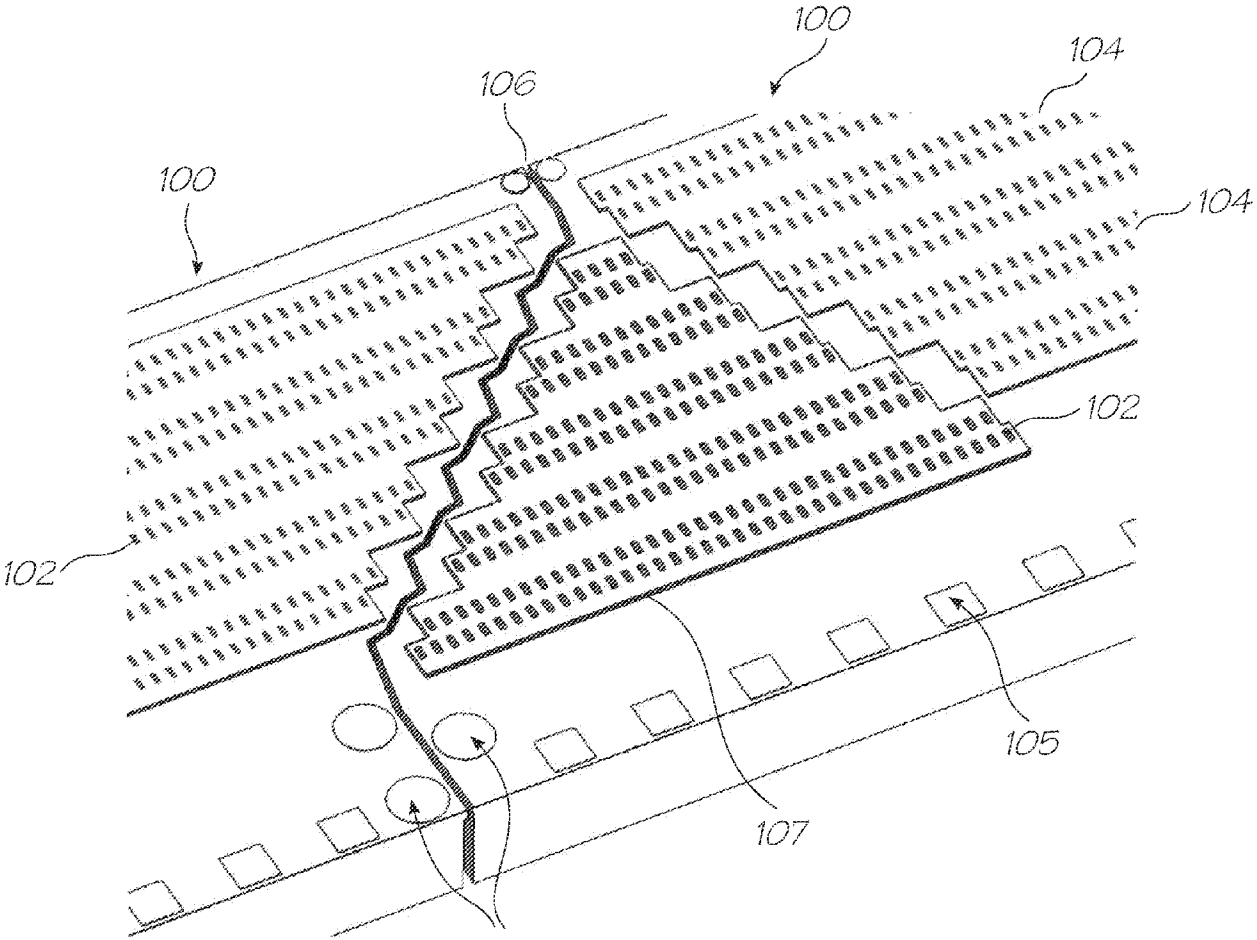
FIG. 2 is a front perspective of a pair of butting printhead integrated circuits.

Hitherto, the Applicant has described printhead integrated circuits (or 'chips') 100 which may be linked together in a butting end-on-end arrangement to define a pagewidth printhead. FIG. 1 shows a frontside face of part of a printhead IC 100 in perspective, whilst FIG. 2 shows a pair of printhead ICs butted together.

Each printhead IC 100 comprises thousands of nozzles 102 arranged in rows. As shown in FIGS. 1 and 2, the printhead IC 100 is configured to receive and print via five color channels (e.g. CMYK and IR (infrared); CCMMY; or CMYKK). Each color channel 104 of the printhead IC 100 comprises a paired row of nozzles, one row of the pair printing even dots and the other row of the pair printing odd dots. Nozzles from each color channel 104 are vertically aligned, in a paper feed direction, to perform dot-on-dot printing at high resolution (e.g. 1600 dpi). A horizontal distance ('pitch') between two adjacent nozzles 102 on a single row is about 32 microns, whilst the vertical distance between rows of nozzles is based on the firing order of the nozzles; however, rows are typically separated by an exact number of dot lines (e.g. 10 dot lines). A more detailed description of nozzle row arrangements and nozzle firing can be found in U.S. Pat. No. 7,438,371, the contents of which are herein incorporated by reference.

The length of an individual printhead IC 100 is typically about 20 to 22 mm. Thus, in order to print an A4/US letter sized page, eleven or twelve individual printhead ICs 100 are contiguously linked together. The number of individual printhead ICs 100 may be varied to accommodate sheets of other widths. For example, a 4" photo printer typically employs five printhead ICs linked together.

The printhead ICs 100 may be linked together in a variety of ways. One particular manner for linking the ICs 100 is shown in FIG. 2. In this arrangement, the ICs 100 are shaped at their ends so as to link together and form a horizontal line of ICs, with no vertical offset between neighboring ICs. A sloping join 106, having substantially a 45° angle, is provided between the printhead ICs. The joining edge has a sawtooth profile to facilitate positioning of butting printhead ICs.

As will be apparent from FIGS. 1 and 2, the leftmost ink delivery nozzles 102 of each row are dropped by 10 line pitches and arranged in a triangle configuration 107. This arrangement maintains the pitch of the nozzles across the join 106 to ensure that the drops of ink are delivered consistently along a print zone. This arrangement also ensures that more silicon is provided at the edge of each printhead IC 100 to ensure sufficient linkage between butting ICs. The nozzles contained in each dropped row must be fired at a different time to ensure that nozzles in a corresponding row fire onto the same line on a page. Whilst control of the operation of the nozzles is performed by a printhead controller ("SoPEC") device, compensation for the dropped rows of nozzles may be performed by CMOS circuitry in a CMOS layer 113 (see FIG. 4) of the printhead, or may be shared between the printhead and the SoPEC device. A full description of the dropped nozzle arrangement and control thereof is contained in U.S. Pat. No. 7,275,805, the contents of which are herein incorporated by reference.

Figure 3:
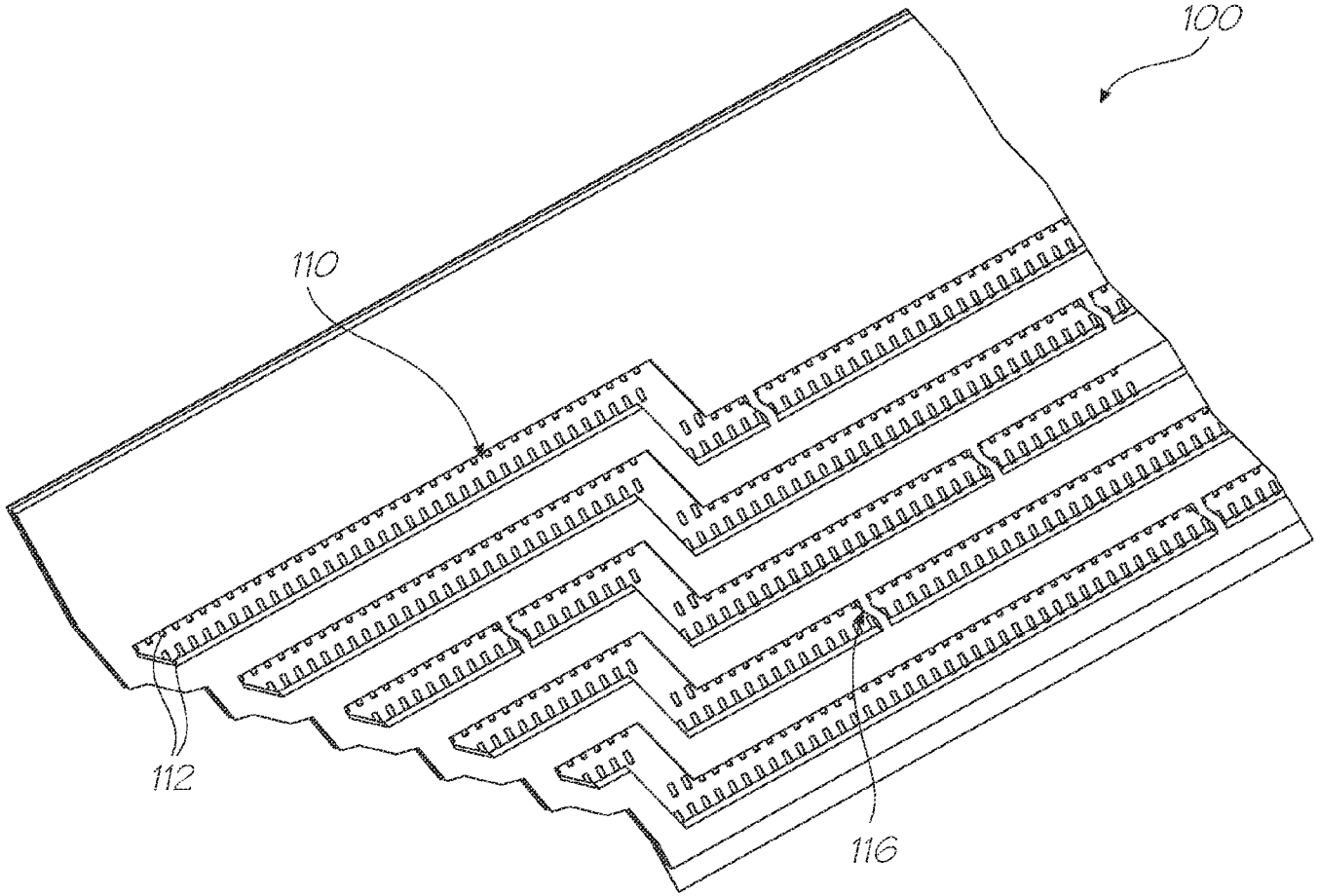
FIG. 3 is a rear perspective of the printhead integrated circuit shown in FIG. 1.
Figure 4:
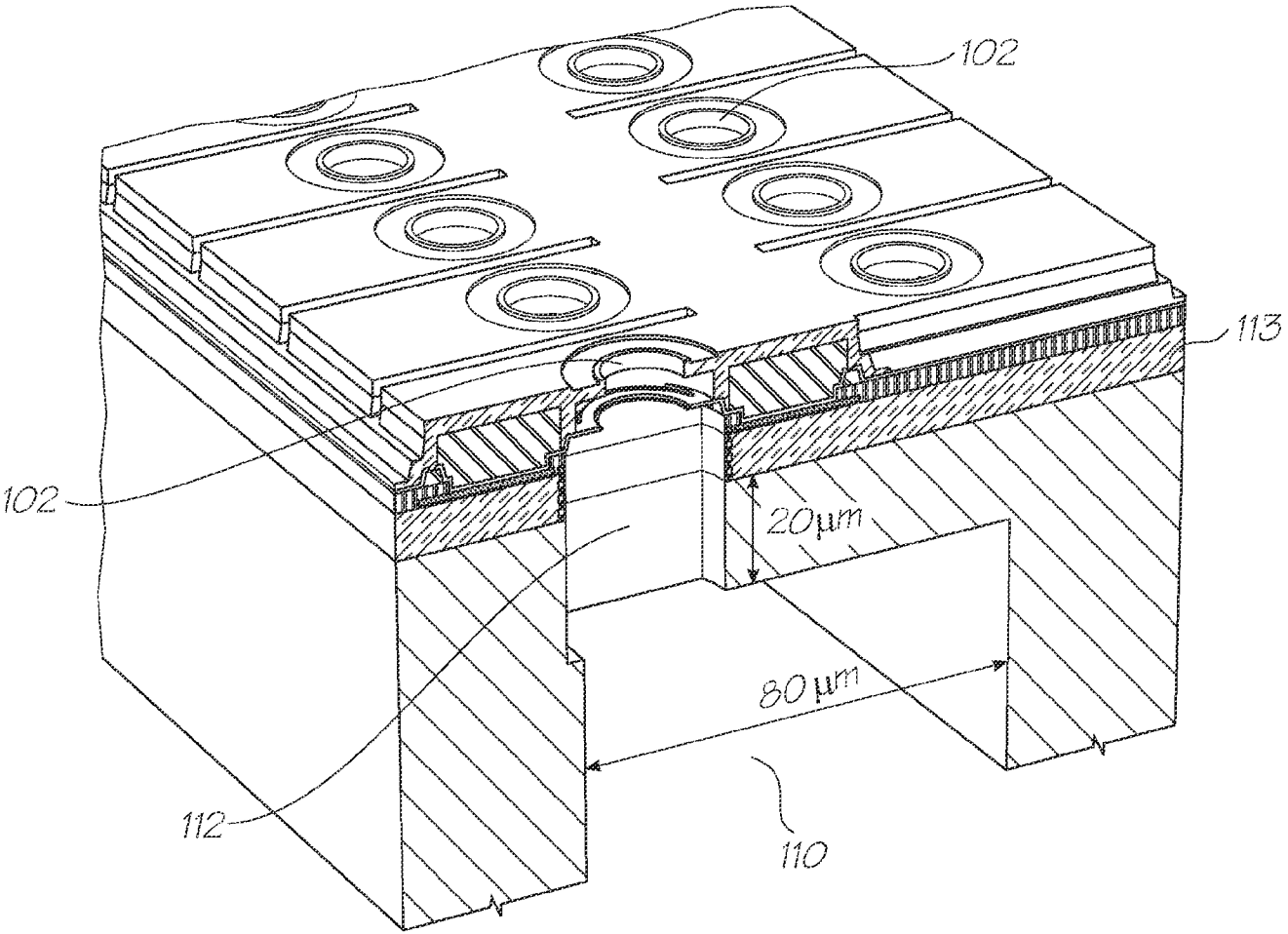
FIG. 4 is a cutaway perspective of an inkjet nozzle assembly having a floor nozzle inlet.
Figure 5:
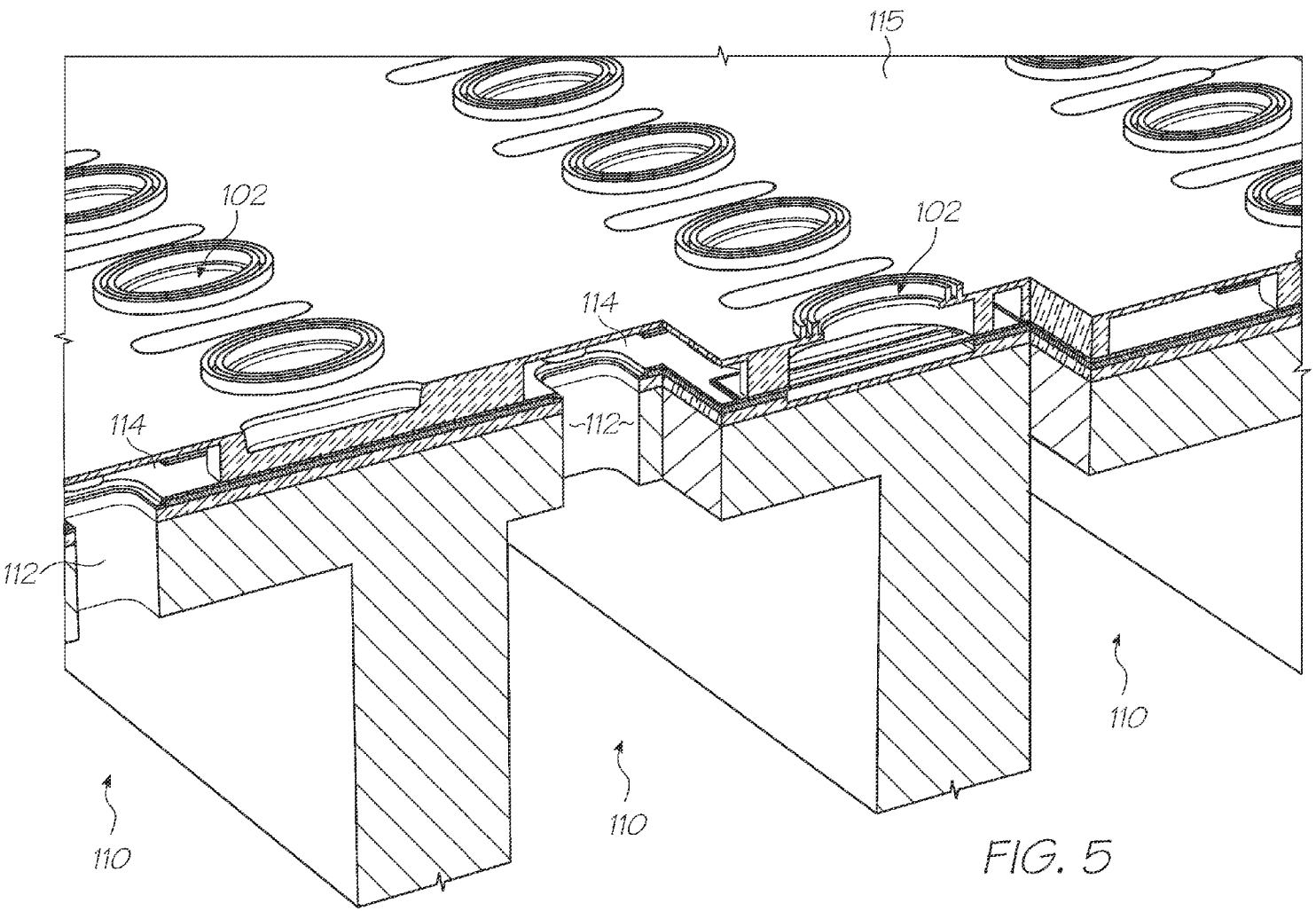
FIG. 5 is a cutaway perspective of an inkjet nozzle assembly having a sidewall nozzle inlet.
Figure 6:
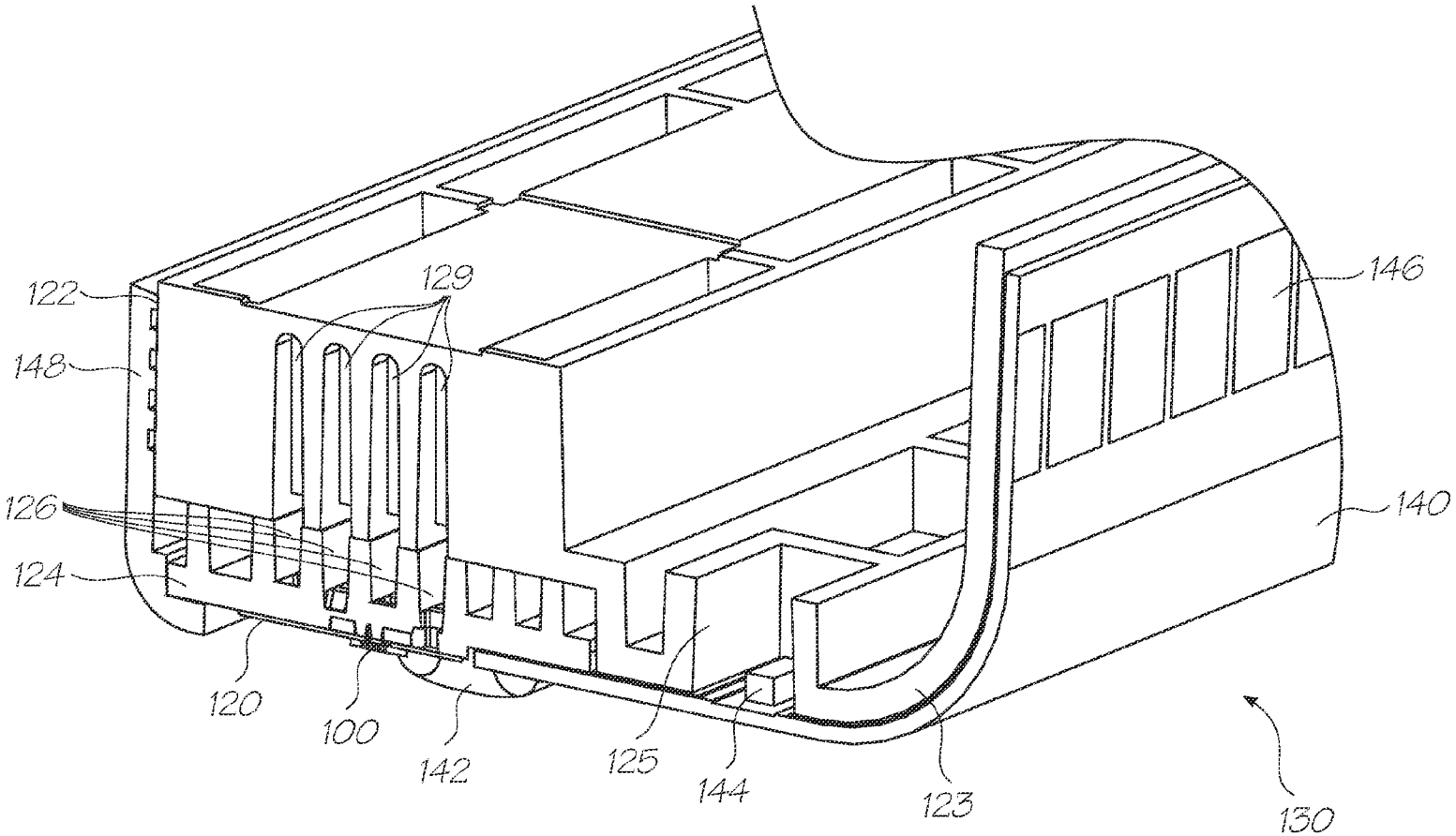
FIG. 6 is a side perspective of a printhead assembly.
Figure 7:
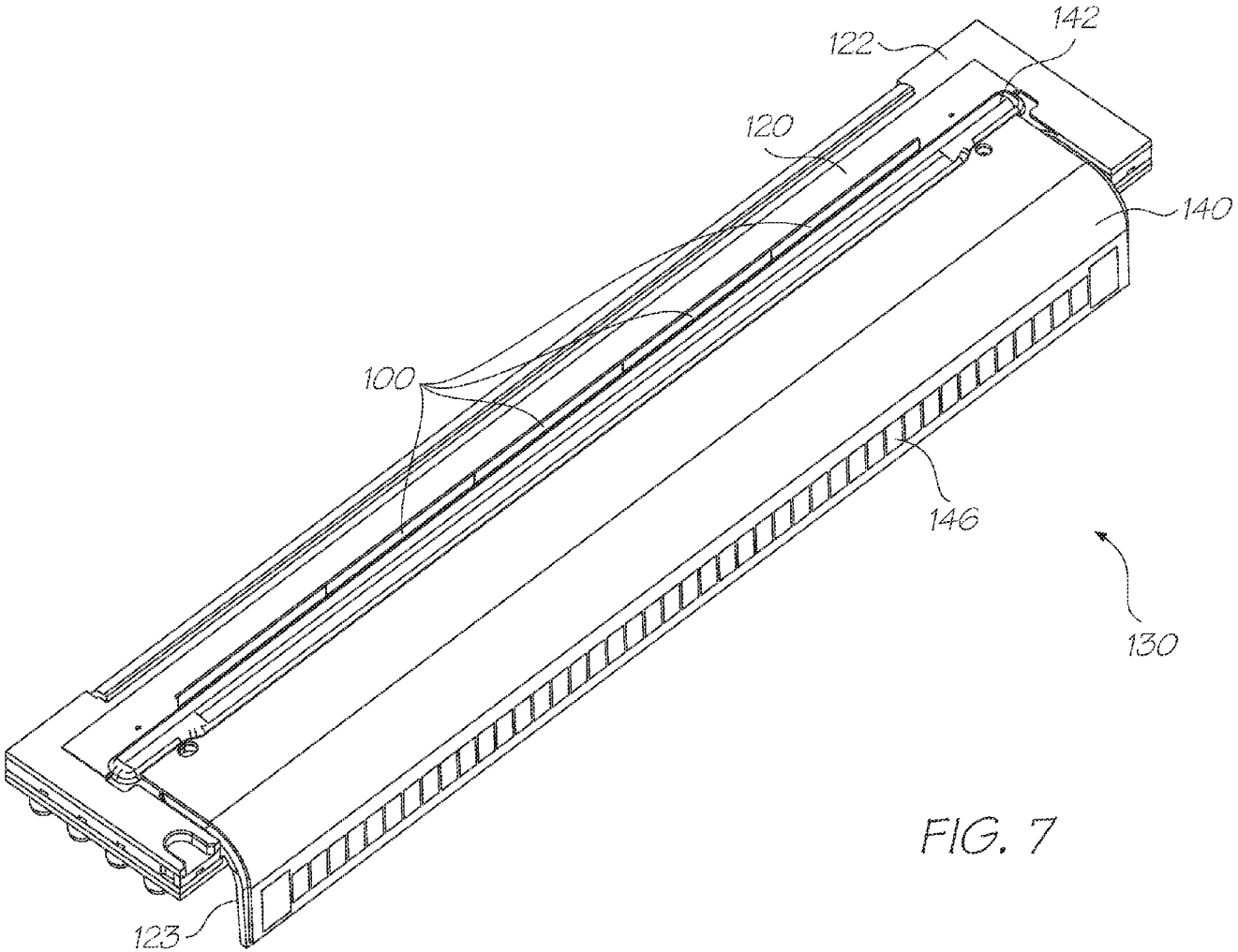
FIG. 7 is a lower perspective of the printhead assembly shown in FIG. 6.
Figure 8:
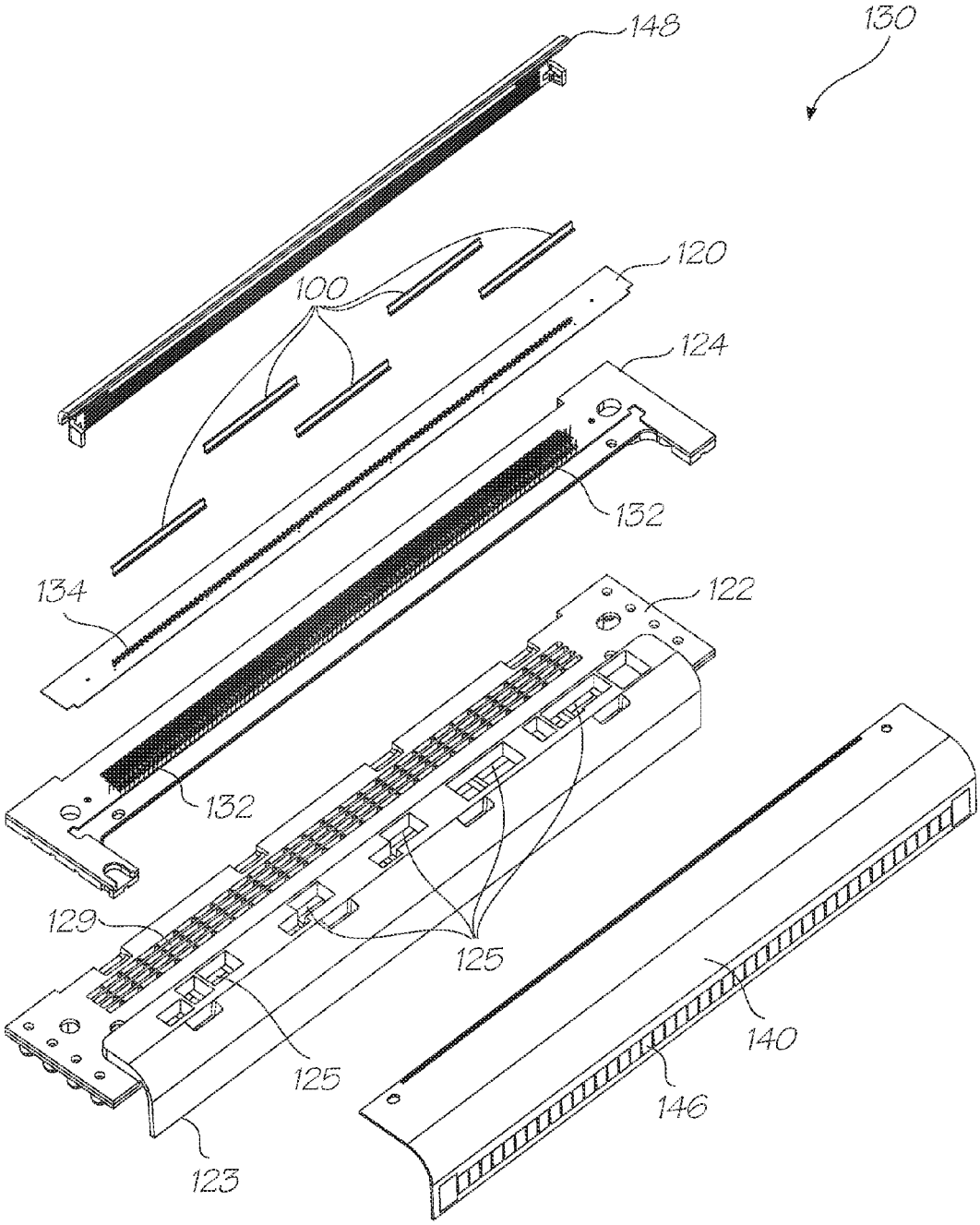
FIG. 8 is an exploded upper perspective of the printhead assembly shown in FIG. 6.

Referring now to FIG. 3, there is shown an opposite backside face of the printhead integrated circuit 100. Ink supply channels 110 are defined in the backside silicon bulk of the printhead IC 100. The ink supply channels 110 extend longitudinally along the length of the printhead IC. Each ink supply channel 110 meets with a plurality of nozzle inlets 112, which fluidically communicate with the nozzles 102 in the frontside. FIG. 4 shows part of a printhead IC where the nozzle inlet 112 feeds ink directly into a nozzle chamber. FIG. 5 shows part of an alternative printhead IC where the nozzle inlets 112 feed ink into ink conduits 114 extending longitudinally alongside each row of nozzle chambers. In this alternative arrangement, the nozzle chambers receive ink via a sidewall entrance from its adjacent ink conduit 114.

Returning to FIG. 3, the longitudinally extending ink supply channels 110 are divided into sections by silicon bridges or walls 116. These walls 116 provide the printhead IC 100 with additional mechanical strength in a transverse direction relative to the longitudinal channels 110.

Ink is supplied to the backside of each printhead IC 100 via an ink supply manifold in the form a two-part LCP molding. Referring to FIGS. 6 to 9, there is shown a printhead assembly 130 comprising printheads ICs 100, which are attached to the ink supply manifold via an adhesive film 120.

The ink supply manifold comprises a main LCP molding 122 and an LCP channel molding 124 sealed to its underside. The printhead ICs 100 are bonded to the underside of the channel molding 124 with the adhesive IC attach film 120 ("die attach film 120"). The upperside of the LCP channel molding 124 comprises LCP main channels 126, which connect with ink inlets 127 and ink outlets 128 in the main LCP molding 122. The ink inlets 127 and ink outlets 128 fluidically communicate with ink reservoirs and an ink supply system (not shown), which supplies ink to the printhead at a predetermined hydrostatic pressure.

The main LCP molding 122 has a plurality of air cavities 129, which communicate with the LCP main channels 126 defined in the LCP channel molding 124. The air cavities 129 serve to dampen ink pressure pulses in the ink supply system.

At the base of each LCP main channel 126 are a series of ink supply passages 132 leading to the printhead ICs 100. The adhesive film 120 has a series of laser-drilled supply holes 134 so that the backside of each printhead IC 100 is in fluid communication with the ink supply passages 132.

Figure 10:
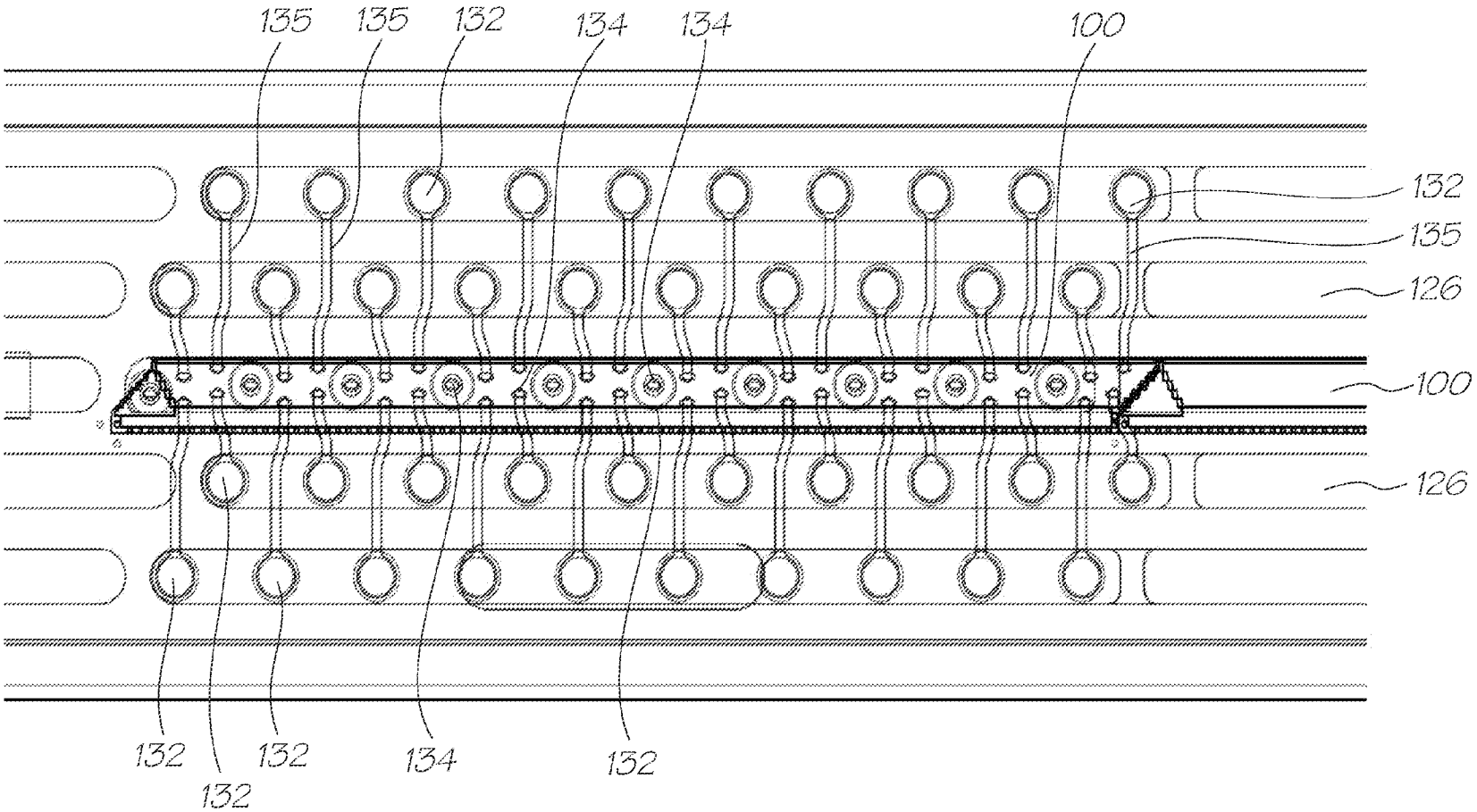
FIG. 10 is overlaid plan view of a printhead integrated circuit attached to an ink supply manifold.

Referring now to FIG. 10, the ink supply passages 132 are arranged in a series of five rows. A middle row of ink supply passages 132 feed ink directly to the backside of the printhead IC 100 through laser-drilled holes 134, whilst the outer rows of ink supply passages 132 feed ink to the printhead IC via micromolded channels 135, each micromolded channel terminating at one of the laser-drilled holes 134.

Figure 11:
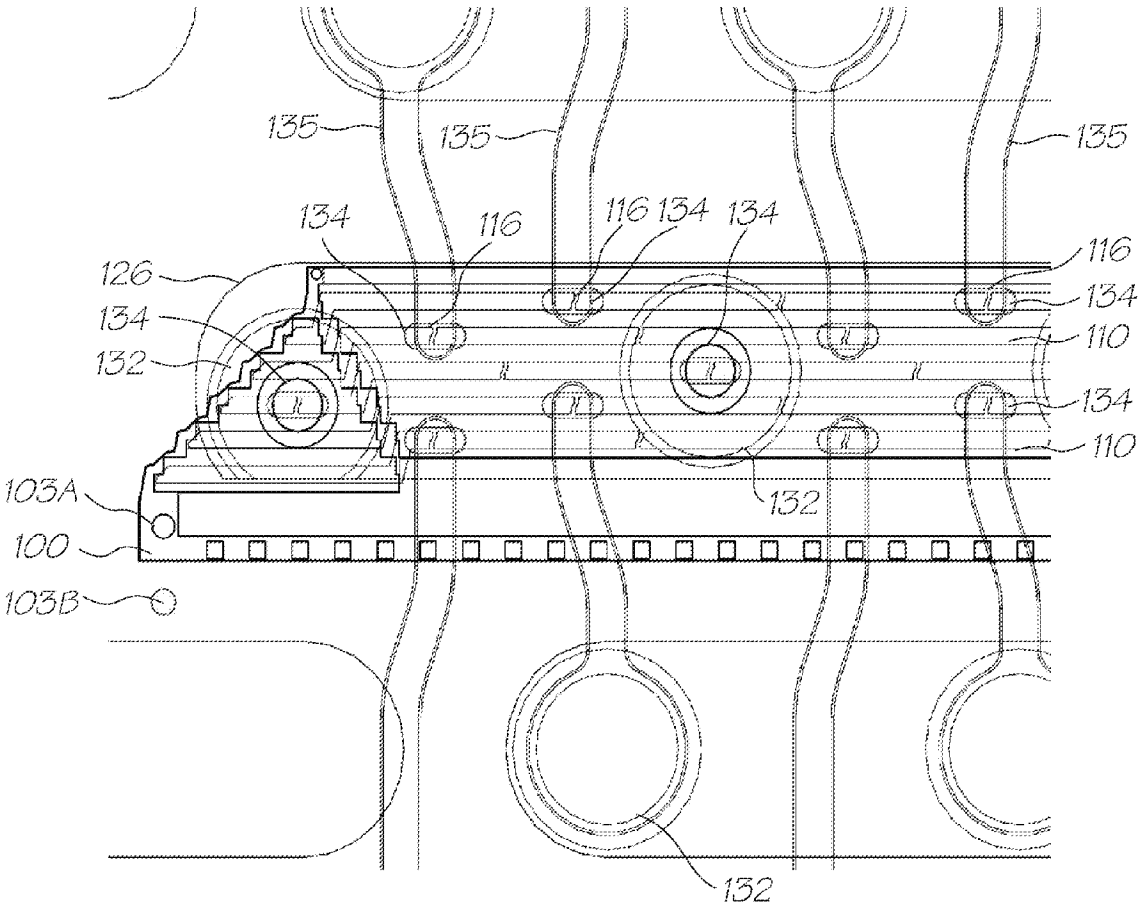
FIG. 11 is a magnified view of FIG. 10.
Figure 12:
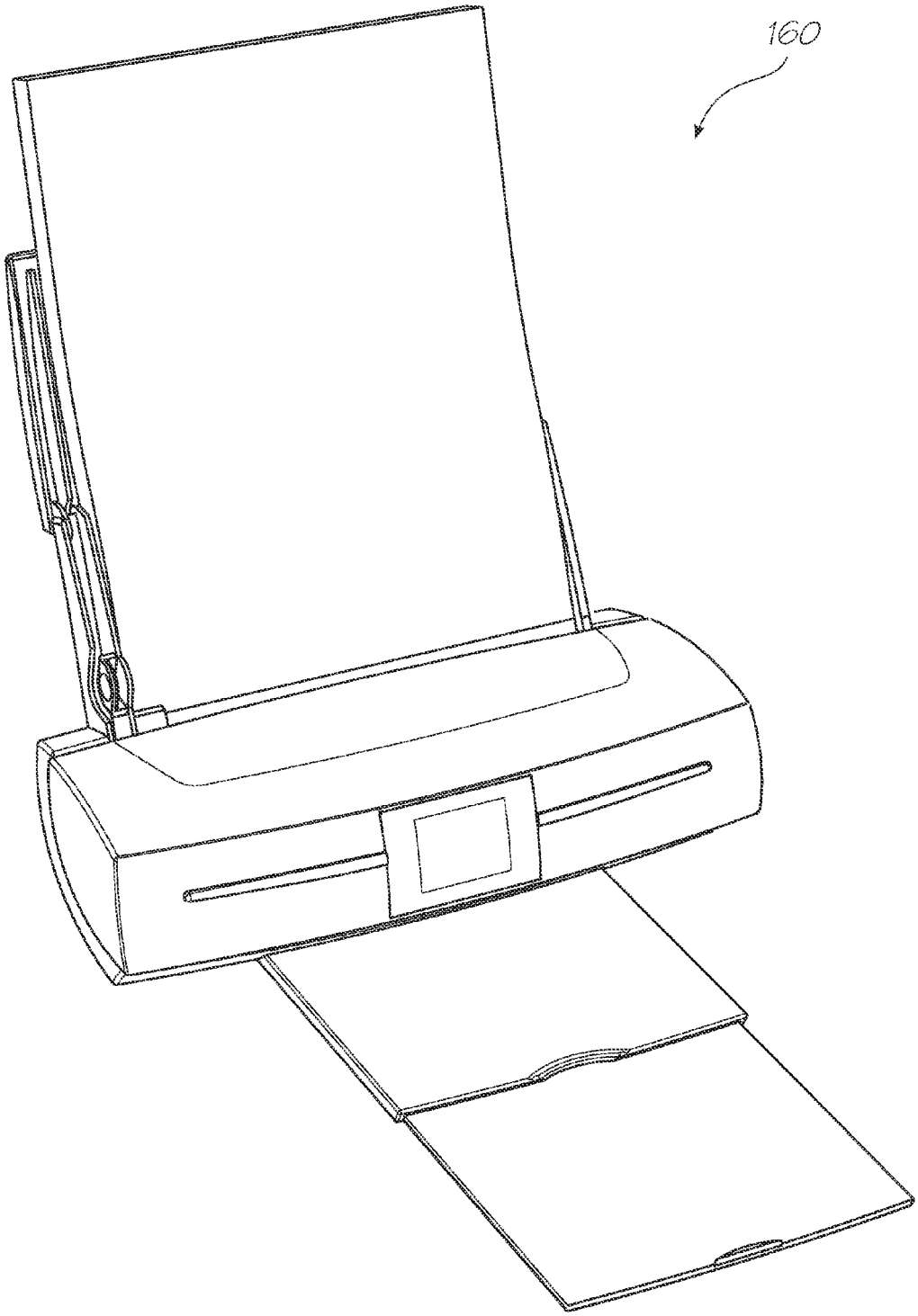
FIG. 12 is a perspective of an inkjet printer.

FIG. 11 shows in more detail how ink is fed to the backside ink supply channels 110 of the printhead ICs 100. Each laser-drilled hole 134, which is defined in the adhesive film 120, is aligned with a corresponding ink supply channel 110. Generally, the laser-drilled hole 134 is aligned with one of the transverse walls 116 in the channel 110 so that ink is supplied to a channel section on either side of the wall 116. This arrangement reduces the number of fluidic connections required between the ink supply manifold and the printhead ICs 100.

To aid in positioning of the ICs 100 correctly, fiducials 103A are provided on the surface of the ICs 100 (see FIGS. 1 and 11). The fiducials 103A are in the form of markers that are readily identifiable by appropriate positioning equipment to indicate the true position of the IC 100 with respect to a neighbouring IC. The adhesive film 120 has complementary fiducials 103B, which aid alignment of each printhead IC 100 with respect to the adhesive film during bonding of the printhead ICs to the ink supply manifold. The fiducials 103A and 103B are strategically positioned at the edges of the ICs 100 and along the length of the adhesive die attach film 120.

It will be appreciated from the foregoing that the printhead assembly 130, comprised of the printhead ICs 100 bonded to the ink supply manifold via the adhesive film 120, comprises a plurality of ink pathways. The ink pathways supply ink to the nozzles 102 and extend from the ink supply manifold into the printhead ICs 100. Each ink pathway has a number of different surfaces which contact ink on its path to the nozzles 102. For example, the surfaces of the LCP main channels 126 are comprised of a liquid crystal polymer; the surfaces of the laser-drilled supply holes 134 in the adhesive film 120 are typically comprised of polyimide and epoxy resin (although, of course, other polymers such as polyesters, polysulfone etc may be used for the adhesive film); the surfaces of the ink supply channels 110 in the printhead ICs 100 are comprised of silicon; and the surfaces of the nozzle chambers and nozzle plate 115 are typically comprised of one or more ceramic materials e.g. silicon oxide, silicon nitride and combinations thereof.

In order to facilitate printhead priming, as well as improving overall print quality, it is desirable for one or more (preferably all) surfaces of the ink pathways to be generally hydrophilic.

Printheads Having Hydrophobic Coating

Referring again to FIG. 5, there is shown a printhead IC 100 having a nozzle plate 115 comprised of a ceramic material. Typically, the nozzle plate is comprised of silicon nitride or silicon oxide, which are relatively hydrophilic materials. Whilst the present invention seeks to hydrophilize surfaces of ink pathways defined in the printhead IC 100, it is equally desirable for the printhead IC to have a relatively hydrophobic surface on the nozzle plate 115. A hydrophobic ink ejection face in combination with hydrophilic ink pathways is optimal for printhead priming and printhead performance, because face flooding is minimized; the hydrophobic/hydrophilic interface pins menisci across the nozzles 102 so as to minimize the tendency for ink to flood onto the ink ejection face.

Hitherto, the Applicant has described methods for hydrophobizing the ink ejection face of printhead ICs. Typically, a hydrophobic polymer layer (e.g. a polymerized siloxane, such as polydimethysiloxane or a polysilsesquioxane) is deposited onto the nozzle plate 115 during MEMS fabrication (see, for example, U.S. Pat. No. 7,669,967 and U.S. patent application Ser. No. 12/508,564 filed on Jul. 24, 2009, the contents of each of which are incorporated herein by reference). A potential problem with this approach is that necessary late-stage 'ashing' (i.e. exposure to an oxidative plasma) to remove photoresist has a tendency to remove at least some of the hydrophobic polymer coating as well as the photoresist. However, the Applicant has overcome this problem by developing a technique whereby the hydrophobic polymer layer is protected with a thin metal film (e.g. aluminum or titanium) during late-stage ashing (see US Patent Publication Nos. US 2008/0225077 and US 2009/0139961, the contents of which are herein incorporated by reference). The thin metal film can be subsequently removed with a suitable wet etchant to reveal the hydrophobic polymer layer.

FIGS. 13 to 16 show a sequence of MEMS processing steps for fabricating a printhead having a frontside hydrophobic polymer layer 80 protected with a metal film 90. It will be appreciated from the subsequent description that such printheads are useful in the present invention, since they are compatible with the hydrophilizing treatments described herein.

Figure 13:
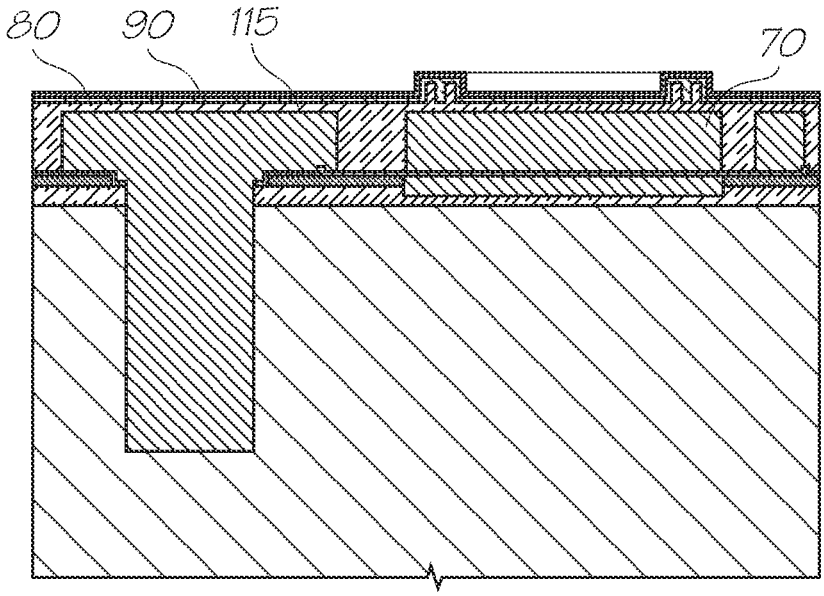
FIG. 13 is a side view of a nozzle assembly in a printhead having a hydrophobic polymer coating and a protective metal film.

Referring to FIG. 13, there is shown a nozzle assembly for a printhead at latter stage of MEMS fabrication described in US Publication No. 2009/0139961. The nozzle chamber and nozzle inlet are filled with photoresist 70, while the nozzle plate 115 has a hydrophobic polymer layer 80 disposed thereon. The hydrophobic polymer layer 80 is itself protected with an aluminum film 90.

Figure 14:
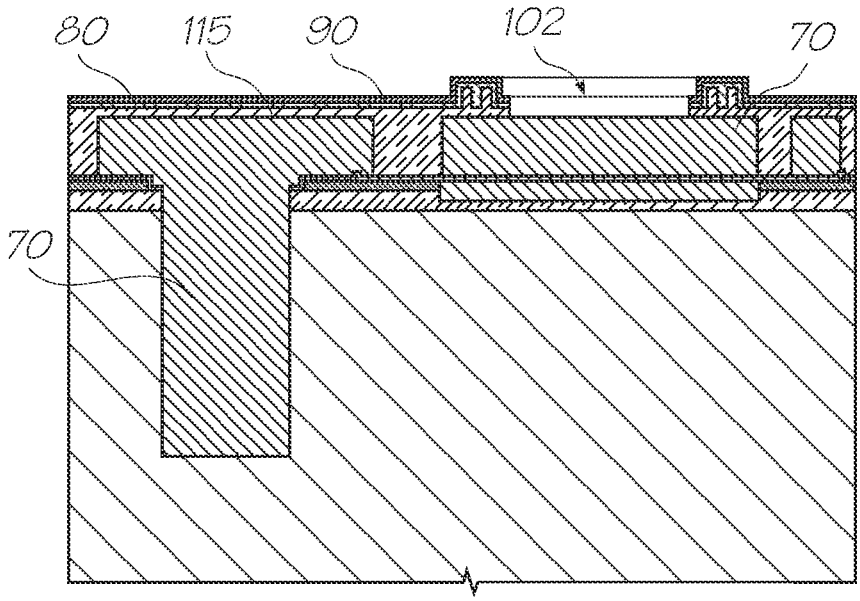
FIG. 14 is a side view of the nozzle assembly shown in FIG. 13 after etching a nozzle opening.

FIG. 14 shows the nozzle assembly after etching the nozzle opening 102 through the metal film 90, the polymer layer 80 and the nozzle plate 115. This etching step typically utilizes a conventional patterned photoresist layer (not shown) as a common mask for all nozzle etching steps. In a typical etching sequence, the metal film 90 is first etched, either by standard dry metal-etching (e.g. $BCl_3/Cl_2$) or wet metal-etching (e.g. $H_2O_2$ or HF). A second dry etch is then used to etch through the polymer layer 80 and the nozzle plate 115. Typically, the second etch step is a dry etch employing $O_2$ and a fluorinated etching gas (e.g. $SF_6$ or $CF_4$).

Once the nozzle opening 102 is defined as shown in FIG. 14, backside MEMS processing steps are performed so as to thin the wafer to a desired thickness and define the ink supply channels 110 (typically using a standard Bosch etch). After wafer-thinning and backside etching, final ashing of the photoresist 70 (either frontside ashing or backside ashing) to reveal the inlet 112, ink conduit 114 and nozzle chamber 74 yields the printhead, as shown (at least in part) in FIGS. 15 and 16. It should be noted that the nozzle plate 115 has the hydrophobic polymer coating 80, which is itself protected with a removable aluminum film 90.

Alkoxylated Polyethyleneimines for Treating Surfaces of Substrates

Plasma activating a substrate increases the surface energy of the substrate surface through the generation of active chemical species, thereby imparting greater hydrophilic character to the substrate surface. The active species formed at the surface are, however, of a higher energy relative to either an untreated surface or the bulk phase beneath the surface. Thermodynamically, this is unfavourable and the system will seek to minimise this energy. Such a process is known as relaxation.

Adsorption and reaction with atmospheric species is commonly credited for the observed relaxation of hard surfaces such as silicon and silicon dioxide. In the case of soft materials, such as plastics, a form of molecular subduction where chemically active species are folded back into the bulk phase of the plastic, thereby returning the surface to a state very close to that of its untreated form, is commonly credited as the relaxation mechanism.

In a printhead assembly (such as the printhead assembly 130 described above) that is comprised of a composite of different materials, some surfaces of the assembly, such as the adhesive joins, are intrinsically more hydrophobic than other surfaces. These more hydrophobic surfaces wet less efficiently and, more importantly, de-wet more readily. Moreover, the rates of relaxation amongst different surfaces of the printhead assembly may vary greatly.

While plasma activation does not generate a uniform surface energy over the composite of materials making up the printhead assembly, the surfaces of a printhead assembly have the maximum degree of surface energy and uniformity of surface energy immediately after these surfaces have been subjected to plasma activation.

In the present invention, the surfaces of ink pathways are treated with an alkoxylated polyethyleneimine solution (e.g. an ethoxylated polyethyleneimine (EPI) solution) following by drying. This treatment process leaves behind a non-volatile, highly wetting, thin film of EPI which is more hydrophilic than the non-treated surface. Usually, the surfaces of the ink pathways are first subjected to plasma activation at atmospheric pressure to activate the surfaces. The plasma activation hydrophilizes the surfaces, whilst the subsequent treatment with, for example, EPI, extends the time over which the activated surface remains hydrophilic.

Sheu et al (*Polymer Surface and Interfaces: Characterization, Modification and Application,* 1997, pp 83-90) describe treatment of plasma activated surfaces with a polyethyleneimine (PEI) solution in order to retard relaxation of the plasma activated surface. At the time of invention, it was generally understood in the art that exposure of a surface activated with a carbon dioxide plasma to a solution of PEI resulted in the formation of an extensive and tightly bound salt complex between the amino functionality of the PEI and the acidic carboxyl groups on the surface formed during plasma processing with the carbon dioxide.

According to the general understanding in the art, the reactivity with which the amino groups of the PEI molecules and the carboxyl groups of the carbon dioxide activated surface interact with each other controlled both the formation and subsequent stability of the salt complex. The higher the proportion of primary amino functionality within the PEI molecule that is accessible by the carboxyl groups, the higher the quality and robustness of the resultant surface layer. Conversely, the higher the steric encumbrance of the amino functionality within the PEI molecules, the less effective the treatment and the quality of the hydrophilic layer that is formed from it.

Significantly, the above implies that functionalised PEI derivatives, where the derivative does not contribute to any macromolecular salt formation, would yield less robust and relatively inferior hydrophilic surfaces. The number of primary amino groups in an ethoxylated-PEI (i.e. EPI), for example, is substantially reduced relative to its parent polymer (PEI) and, at 80% ethoxylation, the amino functionality of EPI is on average far more encumbered sterically than the parent (PEI). Furthermore, since ethoxylation introduces a functional group that does not participate in salt formation it would be expected that EPI would prove to be a less effective agent than PEI for the hydrophilization of a carboxylated surface.

Contrary to the general understanding in the art, the inventors of the present invention found that treatment of an activated surface with EPI formed a superior hydrophilic film compared to that of PEI. The EPI treatment even hydrophilizes surfaces without prior activation by an oxygen plasma, although a greater degree of hydrophilization is achievable with prior plasma activation. Without wishing to be bound by theory, the inventors of the present invention believe that the mechanism of adhesion is through an extensive network of weaker, yet equally prolific, hydrogen bonds rather than salt formation.

In the present invention therefore, EPI is used as a superior alternative to PEI to treat surfaces and, in particular, the plasma activated surfaces of a printhead assembly. The Experimental Section presented hereinbelow demonstrates the superior hydrophilicity of surfaces treated with EPI as compared with PEI. The results are surprising, given that the accepted understanding in the art suggests that EPI would be inferior to PEI.

Moreover, EPI treatment has been shown to be compatible with the Applicant's techniques for hydrophobizing printhead nozzle plates (as described briefly above and described in more detail in US Publication Nos. 2008/0225077 and 2009/0139961). Although EPI tends to hydrophilize the exposed polymer layer 80, which is undesirable, it has been shown that the protective metal film 90 can be removed in the presence of the EPI layer without any appreciable degradation of the EPI layer. This allows removal of the metal film 90 to be performed as a final step in the fabrication of a printhead assembly 130. Accordingly, EPI treatment of the printhead assembly 130 (as described herein) may be followed by a simple wet rinse of the printhead face so as to remove the metal film 90 and reveal the hydrophobic polymer layer 80. This process enables printhead assemblies to be produced having hydrophilic internal ink pathways and a hydrophobic external ink ejection face.

The Experimental Section presented hereinbelow also demonstrates the compatibility of EPI treatment with methods for removing the protective metal film 80.

Methods for Treating Surfaces of Ink Pathways

Activation of the surfaces of ink pathways in the printhead assembly 130 may be performed using an activating plasma, such as an oxygen plasma. The plasma is preferably generated at atmospheric pressure. Oxygen plasma systems suitable for use in the present invention are manufactured by Surfx Technologies LLC, although it will be appreciated that any suitable plasma system may be used.

Figure 9:
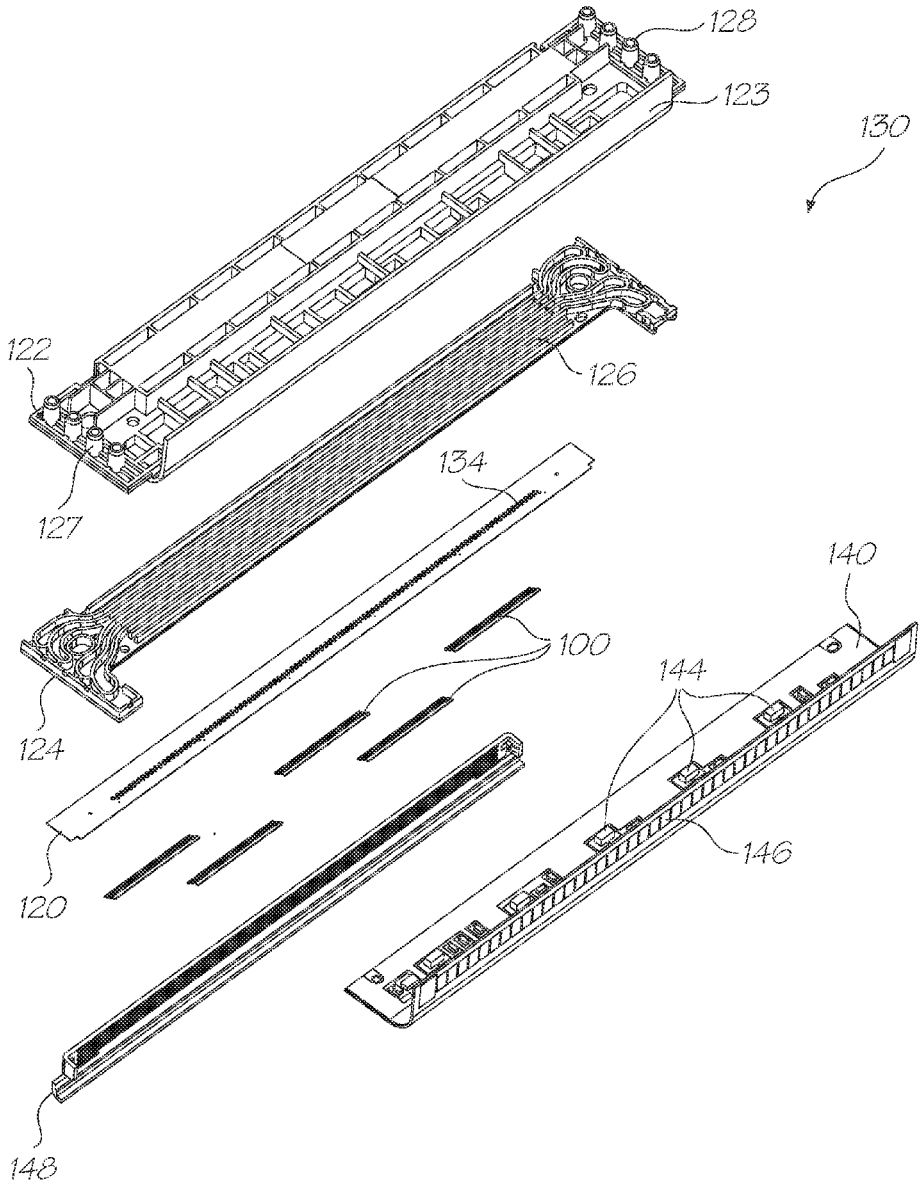
FIG. 9 is an exploded lower perspective of the printhead assembly shown in FIG. 6.

The oxygen plasma may be directed through ink pathways in the printhead assembly 130 using a suitable pressure differential. For example, a vacuum pump (not shown) may be connected to the ink inlets 127 and/or ink outlets 128 (as best shown in FIG. 9). With the ink ejection face of the printhead exposed to the plasma source and the vacuum connected, the oxygen plasma is drawn into the nozzles 102 and flows through the ink pathways of the printhead assembly, so as to provide substantially uniform activation of all surfaces exposed to the plasma. Alternatively or additionally, the pressure differential may be reversed so that the oxygen plasma flows towards the nozzles 102.

By using an atmospheric plasma source, the surfaces of ink pathways in the printhead assembly 130 are activated in an environment at or close to atmospheric pressure. This arrangement overcomes the complexities and disadvantages associated with vacuum plasma processing, previously discussed above.

Following plasma activation, the surfaces of the ink pathways are treated with a solution of alkoxylated polyethyleneimine. The treatment solution is typically introduced into the printhead assembly 130 via the ink inlets 127 and/or ink outlets 128. By virtue of the activated hydrophilized surfaces, the treatment solution flows into the ink pathways by capillary action.

There will now be described three different embodiments, by way of process variants, for hydrophilizing the printhead assembly 130.

First Embodiment for Treating Ink Pathways

Figure 17:
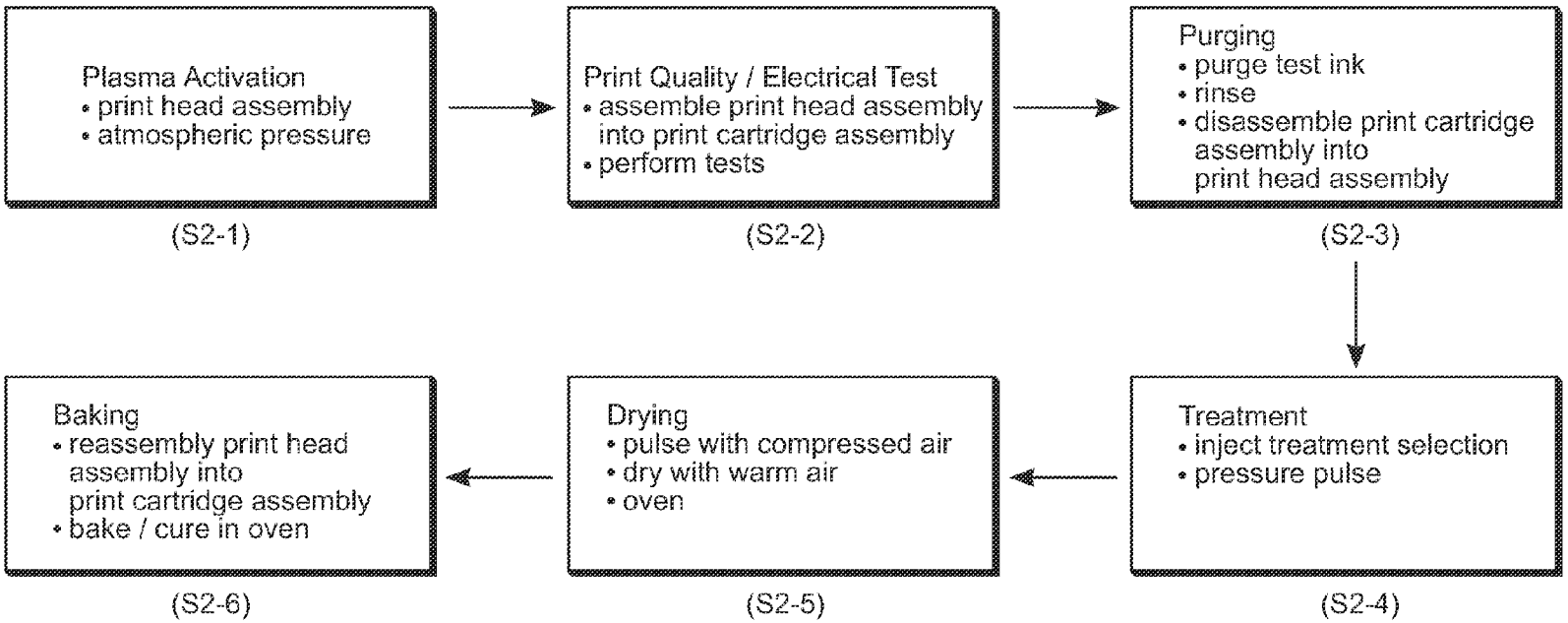
FIG. 17 is a flowchart illustrating a first embodiment for treatment of a printhead assembly in accordance with the present invention.

FIG. 17 is a flow chart illustrating the steps of a first embodiment of the hydrophilizing method of the present invention.

A newly fabricated printhead assembly is first subjected to a plasma activation process (S2-1). In the first embodiment, an $O_2$ plasma is used. The $O_2$ plasma activation process is performed with the printhead assembly at atmospheric pressure.

An atmospheric plasma generating tool (such as those available from Surfx Technologies LLC) is preferably utilized as the plasma source, allowing the printhead assembly to be maintained in an environment at or close to atmospheric pressure. Alternatively, an arrangement utilizing corona discharge directed at the printhead assembly may be used.

Following the plasma activation process (S2-1), the activated printhead assembly is packaged into a print cartridge assembly, whereupon it is primed with ink and the print cartridge assembly subjected to a print quality and electrical testing process (S2-2).

The activated surfaces of the printhead assembly, having raised surface energies, facilitate the rapid ingress of ink into the fluidic channels of the printhead assembly during the print quality and electrical testing process (S2-2). The ink used in the print quality and testing process is comprised of water, water soluble glycols, dyes and surfactants, and hence does not compromise the wetting character of the plasma activated surfaces. The print quality and electrical testing process (S2-2) utilising such ink therefore does not result in any significant deterioration in the hydrophilicity of the printhead assembly generated through exposure to the plasma.

Purging of unused ink, post testing, and rinsing of the printhead assembly with either an ink like vehicle comprising ink like components without a soluble dye, or water, with or without surfactants (S2-3), returns the print quality tested assembly to a condition that retains sufficient surface activation and hydrophilicity.

In an exemplary print quality and electrical testing process, an ink priming test and electrical test of the print cartridge assembly is performed. Then, the print cartridge assembly is washed with deionized water at 40 KPa through the back channels of the printhead assembly, and the water vacuum extracted over 3 cycles at a reduced pressure of −40 KPa at ambient temperature.

Following the purging process (S2-3), the printhead assembly is disassembled from the print cartridge assembly.

As previously mentioned, although the surfaces of the printhead assembly are hydrophilic after the oxygen plasma activation process (S2-1), the activated surfaces relax over time and invariably return to a less-hydrophilic state. To minimize relaxation of the activated surfaces and loss of hydrophilicity, the first embodiment performs a treatment process (S2-4) on the surfaces of the printhead assembly, whereby the internal, active surfaces of the printhead assembly are exposed to an EPI treatment solution. The treatment process (S2-4) is performed after the purging process (S2-3).

The treatment process (S2-4) injects an EPI treatment solution though the ink pathways of the printhead assembly. The treatment solution may be injected through the ink inlets 127 and/or ink outlets 128 of the printhead assembly 130 to the nozzles 102. Alternatively, the treatment solution may be injected from the nozzles 102 so as to also flush contaminants that may have accumulated from the print quality and electrical testing process (S2-2).

To ensure complete exposure of the printhead assembly's internal structure to the treatment solution, the ink pathways of the printhead assembly are blocked and/or subjected to a regime of pressure pulses. The pressure pulses cause a surge flow which dislodges any bubbles that may have been pinned during injection of the treatment solution. Pressure pulsing further compresses any such bubbles, thereby further aiding their release. The ink pathways can be treated either collectively or individually for each color channel. The treatment of individual color channels allows for greater control over the process as variations in reagent flow can be monitored.

As EPI is supplied commercially as a concentrated solution in water, typically between 35 and 40%, a treatment solution containing EPI is preferably formed by further diluting the EPI concentrate with a compatible solvent. In the present embodiment, water is used as it is safe to handle (non-toxic, non-flammable), cheap and easy to dispose off. Furthermore, water does not deactivate high energy surfaces, has itself a high surface tension, and while volatile, does not dry too quickly. Overly quick drying of the EPI solution may cause irretrievable blockages in the micro fluid structures of the printhead assembly Propylene glycol, or other glycols and glycol ethers such as polyethylene glycol-300, with comparable volatility, may further be added to the EPI solution to slow down the drying rate of the EPI solution, allowing the EPI solution to stay fluid for the duration of the process.

An exemplary formulation (by percentage mass) of an EPI treatment solution is as follows:

EPI (0.01% to 10%); typically 0.1%

Propylene glycol (0.1% to 30%); typically 10%/Alternatively, Polyethylene glycol-300 (0.1%- to 30%); typically 10%

Surfactant—e.g. Surfonyl® (0.01% to 5%); typically 0.1%

Water (remaining mass)

Following the treatment process (S2-4), the treated printhead assembly is dried (S2-5).

In an exemplary drying process, purified compressed air is applied to each channel of the printhead assembly at a pressure of 600 KPa. A pressure line is connected to the printhead assembly via an on-off tap or stopcock, and the purified compressed air pulsed through the ink channels by rotating the tap. Since the passage of gas through the fluidic path of each channel is determined by the complexity of its structure and the degree of restriction offered by its smallest feature, pulsing the compressed air ensures that all of the treatment solution is purged from the fluidic path, including any accumulated excess fluid that may have pooled within the printhead assembly's fluidic structure. The frequency and number of pulsing operations is determined based on the effective dryness of the purged printhead. One to six cycles of 10 seconds duration per cycle was found to be effective, but the drying process is not so limited. All channels are subsequently blown through with warm air at 800 KPa for 10 minutes. The warm air is preferably generated by a vortex device, whereby the generated air is substantially free of contaminants. In the exemplary drying process, the printhead assembly is finally placed in an oven at 70° C. for 2 or more hours, with the nozzles of the printhead assembly pointing upwards.

The process of drying the treated printhead substantially removes any water and propylene glycol introduced from the treatment solution. A non-volatile, highly wetting, thin film of EPI is left behind on the surfaces of ink pathways in the printhead assembly 130.

As mentioned above, the treatment solution is a water based solution of an EPI concentrate. Solvation of EPI in water is achieved through hydrogen bonding interactions of water molecules with appropriate receptor sites, viz. the ethoxy and/or amino functionalities of which EPI is comprised. To achieve adhesion of EPI to the hydrogen bonding sites on the activated surface of the printhead assembly, however, the water molecules associated with solvation must be persuaded to leave the treatment solution and allow the hydroxyl groups at the activated surface to take their place. This is most effectively achieved through the thermal displacement of the solvent, i.e. baking.

Baking serves to drive off water molecules, while the excess thermal energy allows the EPI to more rapidly maximise its surface interaction and achieve a stable surface coating. Baking also helps to volatilize any residual propylene glycol left after the drying process. Accordingly, the dried printhead assembly is preferably reassembled into the printhead cartridge and baked/cured in an oven (S2-6). Preferably, the printhead cartridge is cured for 1 to 18 hours at approximately 70° C.

In the first embodiment, the treatment process (S2-4) and drying process (S2-5) are performed after the print quality and electrical testing process (S2-2). In this manner, the thin film of EPI left behind after the drying process (S2-5) is untouched and unaffected by any further processes.

Second Embodiment for Treating Ink Pathways

Figure 18:
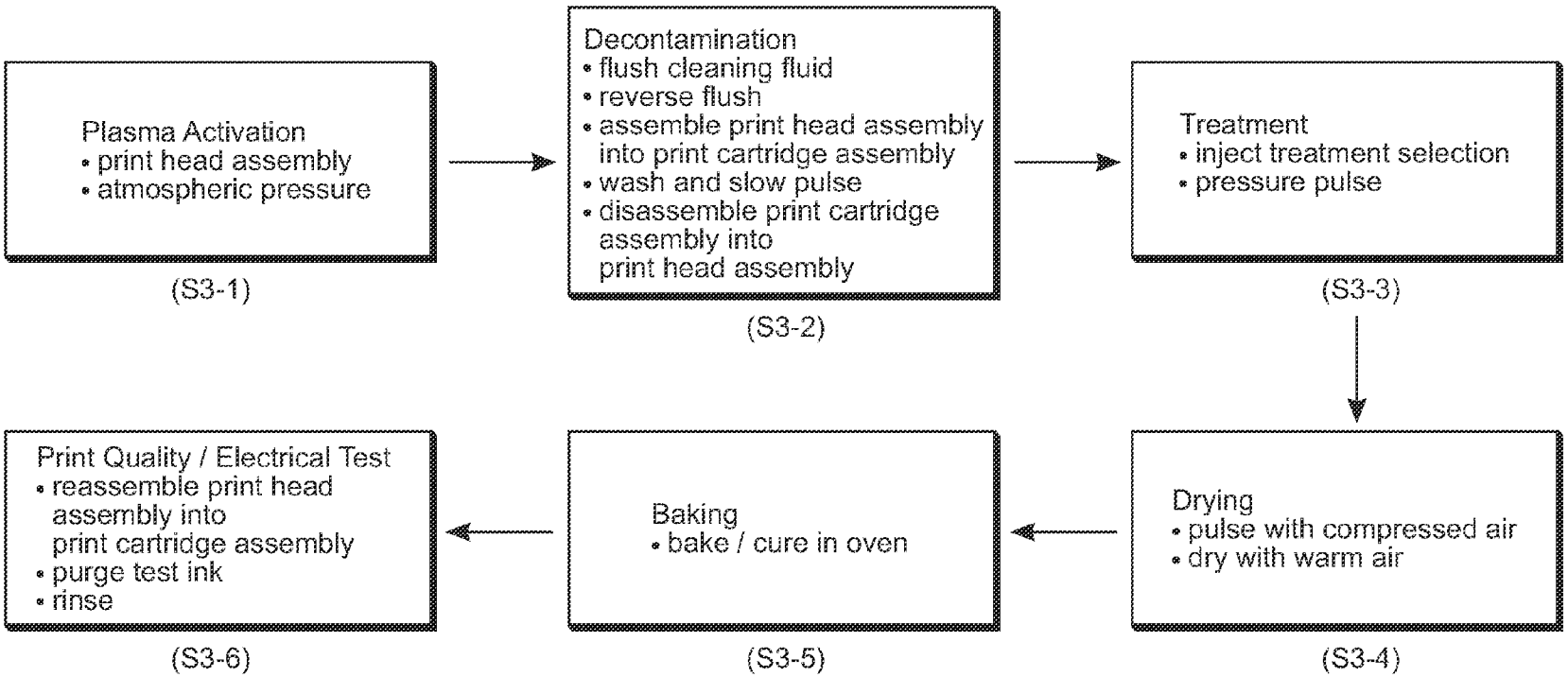
FIG. 18 is a flowchart illustrating a second embodiment for treatment of a printhead assembly in accordance with the present invention.

FIG. 18 is a flow chart illustrating the steps of a second embodiment of the hydrophilizing method of the present invention.

In the second embodiment, a newly fabricated printhead assembly is first subjected to a plasma activation process (S3-1). Similar to the first embodiment, an $O_2$ plasma is used. The plasma activation process (S3-1) is performed with the printhead assembly at atmospheric pressure.

An atmospheric plasma generating tool is preferably utilized as the plasma source. Alternatively, an arrangement utilizing corona discharge directed at the printhead assembly may be used.

Following activation of the printhead assembly, (S3-1) a decontamination process (S3-2) is performed. The decontamination process (S3-2) flushes a cleaning fluid through the printhead assembly 130.

Acceptable cleaning fluids include Surfynol® in deionized water, aqueous glycols and alcohols, other surfactants in deionized water, or a combination of such fluids. Common to these fluids are the characteristic of being water based, having good wetting characteristics, having low surface tension, solubilising of film forming contaminants, volatile (to facilitate rapid drying), and leaving only residues compatible with subsequent wet processing. The cleaning fluids used should further be benign to the printhead assembly material (including glue joints and encapsulants), and preferably be non-toxic, cheap, readily available, and recyclable after filtration.

From the foregoing description of the printhead assembly 130, it will appreciated that the tortuous ink pathways gradually decrease in size from the back of the printhead assembly towards the front of the printhead assembly. The cleaning fluid is therefore reverse flushed from the nozzles 102 on a front face of the printhead assembly, out through the ink inlets 127 and/or ink outlets 128 on a back face. Reverse flushing ensures that the particles of contamination are propagated into channels of ever increasing size. In this manner, the particles of contamination are not trapped in the ink pathways, and do not block or become lodged in the narrower portions of the ink pathway.

In an exemplary decontamination process (S3-2), a reverse flush is performed at 200 ml/min for 200 seconds at 45° C. The printhead assembly 130 is then assembled to form a print cartridge assembly, and the print cartridge assembly washed using a slow pulse of a solution of glycerol and ethylene glycol in water with a soupcon of Surfynol® for 3 cycles, at 3-5 KPa, followed by one 6 second pulse at 80 KPa. The print cartridge assembly is subsequently disassembled back into a printhead assembly.

Following the decontamination process (S3-2), a treatment process (S3-3) using a treatment solution of EPI is performed on the printhead assembly.

The treatment process (S3-3) injects the treatment solution though the inkways of the printhead assembly 130. The treatment process (S3-3) is performed analogously with the treatment process (S2-4) described in connection first embodiment.

As with the first embodiment, the treatment solution of EPI is preferably formed by diluting an EPI concentrate with a compatible solvent. Propylene glycol may further be added to the EPI solution to slow down the drying rate of the EPI solution, allowing the EPI solution to stay fluid for the duration of the process.

A drying process (S3-4) is performed after the treatment process (S3-3). The drying process (S3-4) is performed analogously with the drying process (S2-5) described in connection with the first embodiment The process of drying the treated printhead assembly removes any water and propylene glycol introduced by the treatment solution. A non-volatile, highly wetting, thin film of EPI is left behind on the surfaces of the printhead assembly.

After drying, the printhead assembly is reassembled into the printhead cartridge, and baked/cured in an oven (S3-5). The baking step (S3-5) is performed analogously to the baking step (S2-6) described in connection with the first embodiment. Preferably, the printhead cartridge is baked for 1 to 18 hours at approximately 70° C.

Finally, a print quality and electrical testing process (S3-6) similar to that described in the first embodiment at (S2-2) is performed on the print cartridge assembly, and the print cartridge assembly allowed to sit for a day to dry.

The second embodiment, as compared to the first embodiment, includes an additional decontamination process (S3-2) performed after the plasma activation process (S3-1), but before the treatment process (S3-3). The decontamination process removes particulate contamination and film forming debris from the internal surfaces of the printhead assembly. In this manner, a more efficient and thorough treatment of the internal surfaces is realized.

Further, in the second embodiment, the print quality and electrical testing process (S3-6) is performed after the treatment process (S3-3) and the drying process (S3-4). While the passing of ink through the printhead assembly during the print quality and electrical testing process (S3-6) will dissolve some of the thin film EPI coating the internal surfaces, the rate of dissolution of the thin film is slow, and the time taken to print, test, wash and clean is short in comparison to the time needed to completely dissolve the thin film.

An advantage of performing the treatment process (S3-3) before the print quality and electrical testing process (S3-6), however, is that the treatment process (S3-3) is performed on freshly decontaminated surfaces that have not been exposed to any other substances, such as the inks and flushing fluids used during the print quality and electrical testing process (S3-6). In this manner, a more thorough and efficient treatment of the surfaces is realized.

Third Embodiment for Treating Ink Pathways

Figure 19:
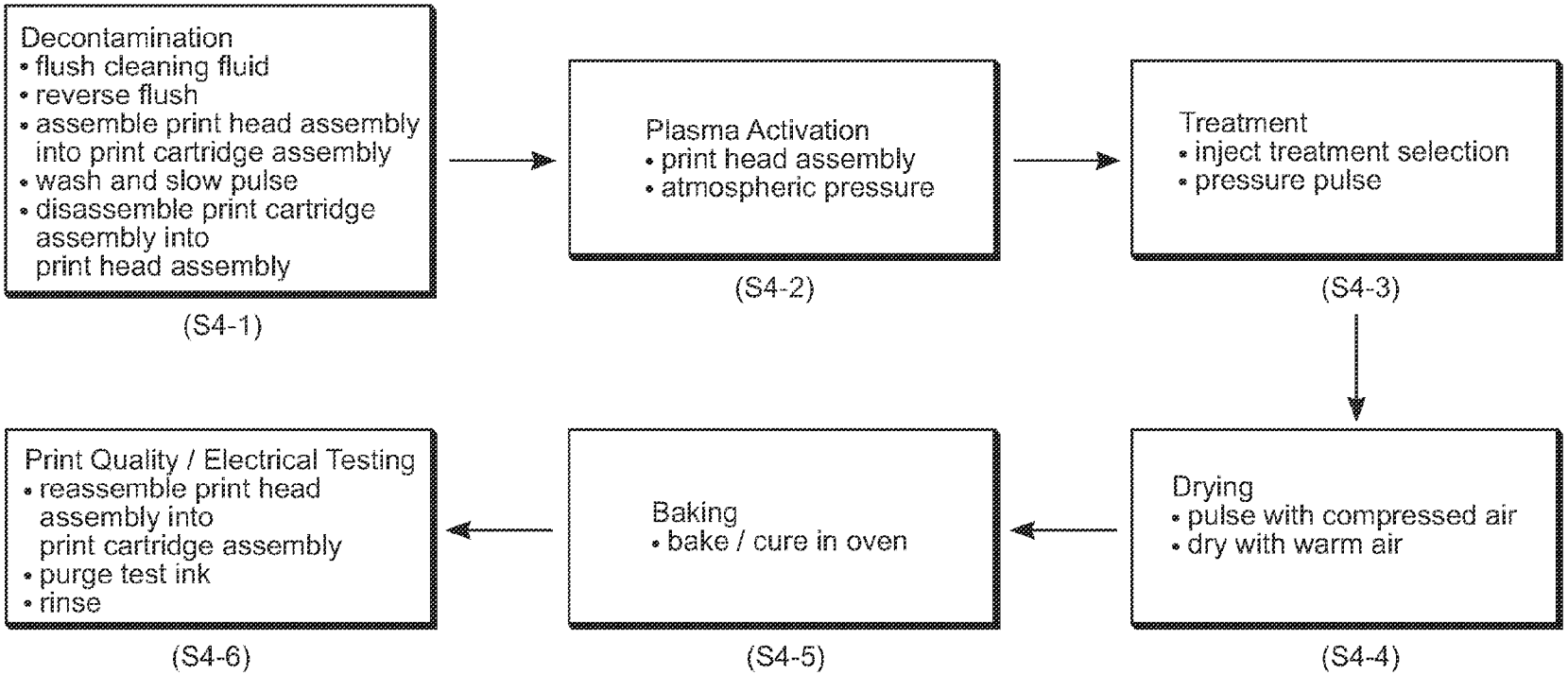
FIG. 19 is a flowchart illustrating a third embodiment for treatment of a printhead assembly in accordance with the present invention.

FIG. 19 is a flow chart illustrating a third embodiment of the hydrophilizing method of the present invention.

In the third embodiment, a printhead assembly is subjected first to a decontamination process (S4-1). The decontamination process (S4-1) reverse flushes a cleaning fluid through the printhead assembly. A reverse flush is performed for reasons as described above in the second embodiment.

It is particularly important in the third embodiment to have no residues left on the internal surfaces of the printhead assembly after the decontamination process (S4-1), since a later step of plasma activation in the third embodiment will by default activate any material the plasma comes into contact with, no matter what this material is, including surfactant residues left behind by the cleaning fluids. The internal surfaces of the assembly should also be completely dried before plasma activation, since residual water, or any fluid, would mask the surface from the plasma species passing over it. While an activated surfactant residue would very likely be highly wetting, a subsequent process of treatment to be performed in the third embodiment might well be compromised.

To leave a truly decontaminated, residue free surface, the cleaning fluid should contain no non-volatile components, and to facilitate drying is preferably readily removed upon exposure to heat. In the third embodiment, therefore, a solvent (such as an alcohol) is used in place of a surfactant, as the cleaning fluid.

Aqueous ethanol is a particularly effective solvent satisfying the above requirements. Propan-1-ol, would also be an effective solvent. Aqueous ethanol has a lower surface tension than water alone and is therefore more wetting. Furthermore, ethanol is a good solvent, evaporates easily, is cheap, relatively safe when diluted, non-toxic and readily available in pure form. Therefore, the third embodiment of the present invention preferably reverse flushes aqueous ethanol as a cleaning fluid in the decontamination process (S4-1).

The cleaning fluid of aqueous ethanol is subsequently thoroughly dried off, thereby completing the decontamination process (S4-1). In an exemplary decontamination process, the printhead assembly is vacuum dried in oven at approximately 70° C. for 2 hours.

Following the decontamination process (S4-1), the printhead assembly is subjected to a plasma activation process (S4-2). Similar to the first embodiment, an $O_2$ plasma is used. The plasma activation process is performed with the printhead assembly at atmospheric pressure.

An atmospheric plasma generating tool is preferably utilized as the plasma source, allowing the printhead assembly to be maintained in an environment at or close to atmospheric pressure. Alternatively, an arrangement utilizing corona discharge directed at, or drawn through the printhead assembly may be used.

Following the plasma activation process (S4-2), the printhead assembly 130 is subjected to a treatment process (S4-3) using a treatment solution of EPI. The treatment process (S4-3) is performed analogously with the treatment process (S2-4) described in connection first embodiment The treated printhead assembly is then dried (S4-4) analogously with the drying step (S2-5) described in connection with the first embodiment.

Following the drying process (S4-4), the printhead assembly is baked/cured in an oven at approximately 70° C. for 1 to 18 hours (S4-5), analogously with the baking step (S2-6) described in connection with the first embodiment.

Following the baking process (S4-5), the printhead assembly is assembled as a print cartridge assembly, and tested for print quality and electrical connections (S4-6). The print quality and electrical testing process is similar to that described in the first embodiment at (S2-2).

In the third embodiment, the decontamination process (S4-1) is performed as one of the first steps of the hydrophilizing method. By performing the decontamination process (S4-1) before the plasma activation process (S4-2), the internal surfaces of the printhead assembly are better exposed to the plasma, and accordingly more complete and optimal surface activation is realized. In particular, particulates or films that might otherwise mask critical areas of the internal structure are removed before the internal surfaces are activated.

In contrast to the first and second embodiments, in which a plasma activation process is performed before a decontamination process, the presence of non-activated surface patches that are less receptive to treatment is significantly reduced.

Further, in the third embodiment, the treatment process (S4-3) is performed effectively immediately after the plasma activation process (S4-2). In this manner, the activated surfaces of the printhead assembly are given less time to relax as compared to the first and second embodiments, and are maintained near their most energetic states. Moreover, as the printhead assembly 130 is made up of a composite of materials, each having different relaxation times, the sooner the treatment process is performed after the plasma activation process, the more uniform the surface energy of the different materials making up the printhead assembly will remain.

Still further, compared to the second embodiment, by performing the treatment process (S4-3) immediately after the plasma activation process (S4-2) instead of intervening a decontamination process therebetween, the treatment process (S4-3) is performed on a freshly activated surface that has not been exposed to other substances, such as those used in the decontamination process (S4-1).

Similar to the second embodiment, the print quality and electrical testing process (S4-6) is performed after the treatment process (S4-3). While the passing of ink through the printhead assembly during the print quality and electrical testing process (S4-6) will dissolve some of the thin film EPI coating the internal surfaces, the rate of dissolution of the thin film is slow, and the time taken to print, test, wash and clean is short in comparison to the time needed to completely dissolve the thin film.

As with the second embodiment, the advantage of performing the treatment process (S4-3) before the print quality and electrical testing process (S4-6) is that the treatment process (S4-3) is performed on freshly decontaminated surfaces that have not been exposed to any other substances, such as the inks and flushing fluids used during the print quality and electrical testing process (S4-6). Accordingly, an even more efficient and thorough treatment of the surfaces is realized.

Post-Processing Packaging and Shipping

The surfaces of a printhead assembly plasma activated and treated according to the disclosed embodiments above are coated with a non-volatile, highly wetting, thin film of EPI that inhibits relaxation of the activated surfaces.

The EPI thin film provides a relaxation-inhibiting effect similar or superior to the wet shipping method described above, whereby the printhead assembly 130 is primed with ink (or an ink like fluid) after fabrication, and remains primed with ink (or an ink like fluid) until use (hereinafter referred to as "wet shipping"). However, the present invention achieves hydrophilizing of ink pathway surfaces, with excellent longevity, without the complexities and inefficiencies associated with wet shipping.

Wet shipping printhead assemblies require the printhead assemblies to be packed in waterproof, perfectly sealed bags. Wet shipping printhead assemblies are intolerant to any deterioration of the sealed environment, and are further susceptible to ink spillage. In contrast, the non-volatile, highly-wetting EPI thin film coating the surfaces of a printhead assembly processed by the disclosed embodiments are macroscopically dry. Accordingly, special packing and sealing requirements are not necessary.

In a further embodiment of the present invention, therefore, printhead assemblies are packaged using more cost efficient packaging than is required for the wet shipping of a printhead assembly. Examples of such packaging include lower grade vacuum packaging, and shrink wrapping.

In a still further embodiment, the printhead assemblies are pre-installed in respective printers, and stored and transported with the printer. The printhead assemblies are stored and transported in a manner insensitive to orientation, allowing for more spatial and time efficient handling of the printhead assemblies throughout the logistics chain, and accordingly, significant cost savings. Storage, transport, and sale of printhead assemblies in this manner are possible since ink spillage from the printhead assemblies during these stages of the logistical chain is entirely prevented.

Moreover, compliance with import/export regulations, shipping classifications, customs classifications, and other legal and procedural complexities involved with the transport of liquids are obviated. Provision of a true "Plug and Play" printing system is also realized.

Experimental Section

A series of experiments will now be described, which demonstrate the superior hydrophilizing of properties of alkoylated polyethyleneimines, especially when compared with their polyethyleneimine counterparts and other polyelectrolytes. Furthermore, the compatibility of alkoylated polyethyleneimines with processes for fabricating printheads with hydrophobic coatings will also be demonstrated.

Luviquat® Treatment (Comparative Example)

Luviquats® are a range of cationic polymers, supplied by BASF. For example, Luviquat® PQ11 (polyquaternium-11) is supplied as an aqueous solution containing a quaternized copolymer of vinylpyrrolidone and dimethlyaminomethylmethacrylate. A Luviquat® treatment was initially trialled in order to investigate whether any polyelectrolyte treatment could retard relaxation of a plasma-activated surface, in accordance with a simple polyelectrolyte ionic interaction model.

A blank silicon tile (20 mm×10 mm) was provided having one silicon oxide surface and an opposite silicon nitride surface. Using the Wilhelmy plate technique the advancing contact angle of the native tile was found to be about 50-60°. In the Wilhelmy plate technique, the tile is immersed slowly into a liquid and the force measured by a sensitive balance. The measured force is the sum of the wetting force, the weight of the plate and the buoyancy. The advancing contact angle is then determined by solving the equation:

$$\text{Wetting force}=sP\cos\theta$$

where s is the liquid surface tension, P is the perimeter of the plate and θ is the advancing contact angle.

The retreating contact angle may be similarly determined by measuring the force when the plate is raised from the liquid.

In order to investigate the hydrophilizing effect of Luviquat® treatment, the silicon tile was treated as follows:

- washed with acetone and deionized water
- plasma activation ("ashing") with an oxygen plasma for 60 seconds
- Luviquat® treatment by immersing for 5 minutes in solution.

Immediately after the plasma/Luviquat® treatment, the tile was found to have an advancing contact angle of about 20°. When left to age under atmospheric conditions for 39 days, the hydrophilicity decreased significantly. After 39 days ageing, the advancing contact angle of the plasma/Luviquat® treated tile was measured to be about 45°.

By way of comparison, a tile having a simple oxygen plasma treatment (with no subsequent Luviquat® treatment) had an initial contact angle of 0°, which increased to about 35° after ageing in atmosphere for 39 days.

It was therefore concluded that the Luviquat® treatment had no effect in improving the hydrophilic robustness of a plasma-treated surface. In fact, the Luviquat® treatment appeared to have a deleterious effect on the hydrophilicity of the treated tile. Accordingly, it was concluded that the polyelectrolyte ionic bonding model proposed by Sheu et al (Sheu et al, *Polymer Surface and Interfaces: Characterization, Modification and Application,* 1997, pp 83-90) was probably flawed. Moreover, it was concluded that Luviquat® treatment was not a viable method for enabling dry shipment of printheads having hydrophilic ink pathways.

Comparison of PEI and EPI Treatments on Silicon and Polymer Substrates

Polyethyleneimines (PEI) are a class of polymer formed by the polymerization of aziridines. They contain a mixture of primary, second and tertiary amine functionalities, have excellent water solubility and are readily available in a range of molecular weights. As discussed above, Sheu et al have demonstrated the hydrophilizing properties of PEI, following activation of a surface with carbon dioxide. Alkoxylation of polyethyleneimines (typically using an alkylene oxide) yields alkoxylated polyethyleneimines (or, more formally, "hydroxyalkylated polyethyleneimines"). For example, ethoxylated polyethyleneimine (EPI) is a well-known, commercially available polymer which is used as a dispersant in laundry detergents. In ethoxylated polyethyleneimines, a number (e.g. about 80%) of the primary and second amine functionalities are ethoxylated ("hydroxyethylated"). A range of ethoxylated polyethyleneimines are available from Sigma Aldrich as well as from BASF under the trade name Lupasol®.

A selection of ink pathway surfaces found in the printhead assembly 130 described above were investigated using PEI and EPI treatments. Three substrates were investigated:

(1) an LCP token ("LCP"), modelling the LCP ink supply manifold comprised of the main LCP molding 122 and the LCP channel molding 124;

(2) a strip of cured die attach film ("DAF"), modelling the die attach film 120 having cured external epoxy surfaces on either side of a polyimide layer (3) a silicon tile ("Si"), modelling the surfaces of the ink supply channels 110 in the printhead.

All three substrates were attached to a glass microscope slide and treated as follows:

- washed with methanol and dried with warm air from a hair dryer
- plasma-activated using a Surfx tool operating at 120 W with a helium flow rate of 0.20 L/min and an oxygen flow rate of 11.0 L/min. The surfaces were treated with two passes of the plasma at a traverse rate of 5 mm/s
- treated immediately with 1 mL of a methanolic solution containing either PEI or EPI and a fluorosurfactant (Zonyl® FS-300). The PEI had a molecular weight ($M_n$) of 423 Da; the EPI was 80% ethoxylated and had a molecular weight ($M_n$) of 50 kDa.
- blow dried with compressed air at 50 kPa
- stored at 60° C. in a standard oven After treatment and storage, the substrates were tested for hydrophilicity using a standard drop spread technique. The drop spread technique is suitable for estimating the relative hydrophilicity of surfaces having low contact angles. In each case, a 35 microliter droplet of cyan ink was dispensed onto the surface and the size of the droplet spread measured. To some extent, the polymer surfaces gave irregular drop spreads, but the silicon surface gave consistently symmetrical drop spreads. The drop spread results are shown in Table 1. Irregular drop spreads are marked with an asterisk (*).

TABLE 1

Comparison of PEI and EPI treatments after $O_2$ plasma activation

| | 2.5% PEI + 0.5% surfactant | | | 5% PEI + 1% surfactant | | | 2.5% EPI + 0.5% surfactant | | |
|---|---|---|---|---|---|---|---|---|---|
| Days at 60° C. | LCP | DAF | Si | LCP | DAF | Si | LCP | DAF | Si |
| 1 | 0.59 | 0.59 | 0.73 | 0.59 | 0.59 | 0.71 | 0.77 | 0.73 | 0.75 |
| 2 | 0.58 | 0.51 | 0.62 | 0.56 | 0.55 | 0.70 | 0.70 | 0.82 | 0.81 |
| 5 | 0.78* | 0.57 | 0.70 | 0.62 | 0.76* | 0.70 | 0.85 | 0.64 | 0.77 |
| 7 | 0.73 | 0.67* | 0.73 | 0.76 | 0.80* | 0.72 | 0.78 | 0.95* | 0.78 |
| 22 | 0.66 | 0.47 | 0.53 | 0.63 | 0.54* | 0.57 | 0.70 | 0.58 | 0.74 |

From the results shown in Table 1, it can be seen that the EPI treated surfaces showed a consistently higher degree of drop spread for all surface types. Silicon tiles treated with EPI returned consistently to very high hydrophilicity (as evidenced by drop spread), even after prolonged storage. At all times, EPI treatment of the silicon surface and the polymer surfaces generally outperformed the PEI treatment.

Since the silicon surface of ink supply channel 110 in the printhead assembly 130 is the most important surface in terms of priming and printhead performance, and since experimental observations were consistently more reliable for the silicon surface, subsequent experiments focused on the silicon surface.

Comparison of Different Molecular Weight PEIs and EPIs on Silicon Substrate

Following on from the results presented in Table 1, further experiments were conducted to investigate the effect (if any) of the molecular weight of the PEI and EPI polymers.

Five PEI samples, ranging in molecular weight from 1.2 kDa to ~1 MDa, and two EPI samples (80% ethoxylated) of molecular weight 50 kDa and 70 kDa (all purchased from Sigma Aldrich) were assessed. The polymers were formulated in a wetting vehicle consisting of: propylene glycol (10%), Surfynol® (0.1%) and Proxel® (0.1%).

As described previously, silicon tiles were attached to clean microscope slides with double-sided tape and then washed with acetone (~5 mL) and deionized water (~5 mL) before being dried with warm air from a hairdryer.

Each tile was plasma-activated using a Surfx tool operating at 120 W with a helium flow rate of 0.2 L/min and an oxygen flow rate of 11.0 L/min. The surfaces were treated with two passes of the plasma at a traverse rate of 5 mm/s.

Immediately after plasma-activation, the tiles were wetted with 0.5 mL of 1% EPI or PEI formulated in the wetting vehicle, and blown dry with compressed air at 40 kPa. By way of control, some tiles were plasma treated only and were not exposed to any wetting solutions. The prepared tiles were stored at 70° C. in a conventional oven and representative samples were removed periodically for standard drop spread analysis. The drop spread results are shown in Table 2.

TABLE 2

Comparison of wetting characteristics for different PEIs and EPIs

| Treatment solution (1%) | $M_n$ | Drop spread (mm) on Si after storage at 70° C. 18 hours | 2 days | 6 days | 14 days |
|---|---|---|---|---|---|
| PEI 1.2K | 1.2 kDa | 6.4 | 5.9 | 6.5 | 7.3 |
| PEI 1.8K | 1.8 kDa | 5.9 | 6.1 | 6.8 | 7.6 |
| PEI 10K | 10 kDa | 6.1 | 6.5 | 7.0 | 7.3 |
| PEI 60K | 60 kDa | 5.9 | 5.9 | 7.1 | 7.8 |
| PEI 1M | 1 MDa | 5.8 | 5.7 | 6.8 | 7.6 |
| EPI 50K | 50 kDa | 7.6 | 7.0 | 7.1 | 8.2 |
| EPI 70K | 70 kDa | 7.4 | 6.8 | 7.3 | 8.2 |
| None (plasma only) | n/a | 7.2 | 6.4 | 4.8 | 3.5 |

All five of the PEI-treated samples showed an apparent increase in hydrophilicity upon storage. This general trend was mirrored by the two EPI-treated samples and suggests there may be a maturation, or increase, in hydrophilicity upon elevated temperature storage. There appeared to be no compelling evidence that an optimal wetting performance is associated with any particular molecular weight polymer.

Of greater significance, however, was the consistently higher wetting performance of tiles treated with the ethoxylated polyethyleimines. The EPI-treated tiles exhibited far better wetting than any of the PEI-treated tiles.

By way of control, tiles that were plasma treated alone showed a rapid decline in surface wettability, consistent with the known relaxation of plasma-activated silicon surfaces and more fully demonstrating the permanent and excellent hydrophilizing character of EPI treatments. The contact angles of EPI-treated silicon tiles were estimated to be 4° or less, even after prolonged storage and exposure to atmospheric conditions.

EPI-Treatment Process Variations

The EPI-treatment protocol, as described above, was investigated with various processes so as to mimic possible printhead treatments prior to dry shipment.

Silicon tiles were attached to microscope slides and prepared as described earlier. Combinations of four process steps were evaluated.

(1) The first process ("PIWD") combined 4 steps:

P: Atmospheric oxygen plasma activation.

I: Ink-dipped (cyan ink) for 30 seconds.

W: DI water washed (until judged clean) and blown dry.

D: Dipped in a 0.1% solution of EPI (50 KDa in wetting vehicle) and blown dry.

(2) The second process ("IWD") combined 3 steps:

I: Ink-dipped (cyan ink) for 30 seconds.

W: DI water washed (until judged clean) and blown dry.

D: Dipped in a 0.1% solution of EPI (50 KDa in wetting vehicle) and blown dry.

(3) The third process ("PD") combined 2 steps:

P: Atmospheric oxygen plasma.

D: Dipped in a 0.1% solution of EPI (50 KDa in wetting vehicle) and blown dry.

(4) The fourth process ("P") involved plasma activation only and no wet treatment:

P: Atmospheric oxygen plasma.

The conditions under which plasma activation, EPI treatment and drop spread analysis were conducted were exactly as described above. The results are shown in Table 3.

TABLE 3

Effect of Different Processes on EPI-treatment

| Process | Drop spread (mm) on Si after storage at 70° C. 0 days | 1 day | 2 days | 5 days | 7 days | 10 days | 20 days | 35 days |
|---|---|---|---|---|---|---|---|---|
| PIWD | 8.6 | 9.3 | 9.1 | 9.9 | 9.1 | 8.7 | 9.2 | 8.8 |
| IWD | 7.8 | 9.0 | 8.9 | 9.7 | 9.0 | 8.5 | 9.3 | 8.2 |
| PD | 8.6 | 9.0 | 9.5 | 9.7 | 8.9 | 8.5 | 9.0 | 9.6 |
| P | 7.8 | 7.2 | 6.4 | 4.8 | 4.2 | 3.5 | 3.2 | |

The results in Table 3 demonstrate that the EPI-treatment may be incorporated into a variety of different printhead processing protocols and still retain its hydrophilic character.

The resistance of EPI to "wash-off" is clearly an important parameter and it appears that drying, preferably baking, is essential so as to ensure adhesion of the EPI to the surface via hydrogen bonding. Without at least a drying step, the EPI can be readily washed off rendering the surface less hydrophilic.

Remarkably, treatment of EPI on a non-activated surface ("IWD") still provided a very hydrophilic surface with excellent robustness and longevity. Therefore, plasma-activation of the surface is not, in fact, essential, although optimal hydrophilization is still achieved when the EPI treatment is performed immediately after plasma-activation.

Treatment of Non-Activated Silicon Substrates

Having established that EPI, surprisingly, hydrophilizes non-activated silicon surfaces, the robustness of such treatments was investigated more thoroughly. Silicon tiles were prepared and treated with EPI solutions as described in Table 4.

TABLE 4

EPI Treatments on Non-Activated Silicon Substrates

| Treatment | Process Description | Drop spread (mm) at 0.1% EPI | Drop spread (mm) at 1.0% EPI |
|---|---|---|---|
| 1 | Dipped into EPI solution (in wetting vehicle) and immediately washed off with deionized water | 4.7 | 4.6 |
| 2 | Dipped into EPI solution and blown dry before washing off with DI water | 7.4 | 8.1 |
| 3 | Dipped into EPI solution, blown dry and not washed off | 7.9 | 7.0 |
| 4 | Dipped into EPI solution, blown dry and baked for 1 min at 70° C. | 8.2 | 7.4 |
| 5 | Dipped into EPI solution, blown dry, baked for 1 min at 70° C. and then washed with DI water | 8.1 | 9.3 |
| 6 | Dipper in DI water, blown dry and baked for 1 min at 70° C. | 4.0 | 4.0 |

This series of treatments confirmed that EPI treatment hydrophilizes non-activated silicon substrates. Furthermore, it was established that drying of the EPI film is essential (comparing Treatment 1 with Treatments 2-5), and that baking improves uniformity and performance. There appeared to be no real advantage in adopting higher concentrations of active.

Compatibility of EPI Treatments With Processes for Fabricating Hydrophobically-Coated Printheads As already discussed herein, the Applicant has developed processes for fabricating printheads having a hydrophobic coating disposed on the nozzle plate 115. The hydrophobic coating may be a polymerized siloxane, such as polydimethylsiloxane or a polysilsesquioxance, although other hydrophobic polymer coatings are equally possible using the methods described in the Applicant's US Publication Nos. 2008/0225077 and 2009/0139961.

A series of experiments were performed to investigate the compatibility of the EPI treatments described above with printheads having a hydrophobic polymer coating.

Initially, a PDMS-coated wafer was exposed to an oxygen plasma at atmospheric pressure and then dipped in a 0.1% solution of EPI in the wetting vehicle described above. The wafer was blown dry and then baked in an oven at 70° C. In subsequent drop spread analyses, the PDMS layer consistently had drop spreads of about 9 mm, even after baking for 3 days, indicating the PDMS layer had become robustly hydrophilic. By contrast, a PDMS-coated wafer exposed to an oxygen plasma without subsequent EPI treatment recovered rapidly (relaxed) to its original hydrophobic state. Therefore, it was concluded that the EPI treatment protocol could not be used with exposed polymer printhead coatings (e.g. polymerized siloxane coatings), because the polymer coating did not relax after treatment with EPI.

Following these initial experiments with PDMS-coated wafers, the compatibility of methods for removing the aluminum film 90 with EPI-treated printhead materials were then investigated.

It was found that treatment with a 2.5% solution of tetramethylammonium hydroxide (TMAH) successfully stripped the aluminum film 90 from a PDMS-coated wafer without adversely affecting the hydrophilicity of other printhead materials, which had received the EPI treatment. In particular, it was found that a cured adhesive film 120 and an LCP coupon which had received the EPI-treatment could be subsequently treated with TMAH and still retain their wetting behaviour after rinsing and drying.

Figure 15:
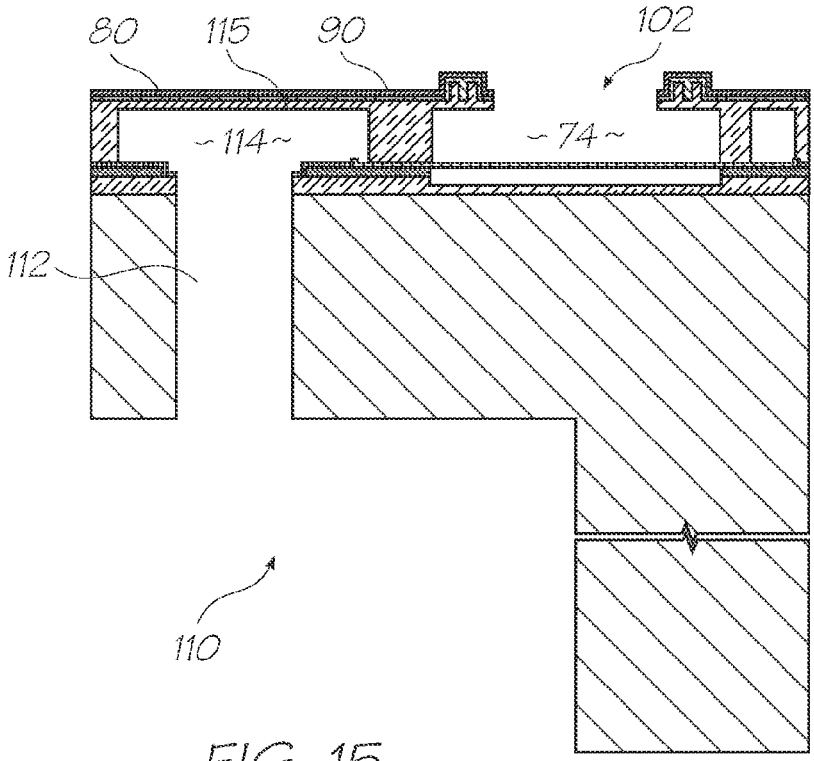
FIG. 15 is a side view of the nozzle assembly shown in FIG. 14 after backside MEMS processing and photoresist removal.
Figure 16:
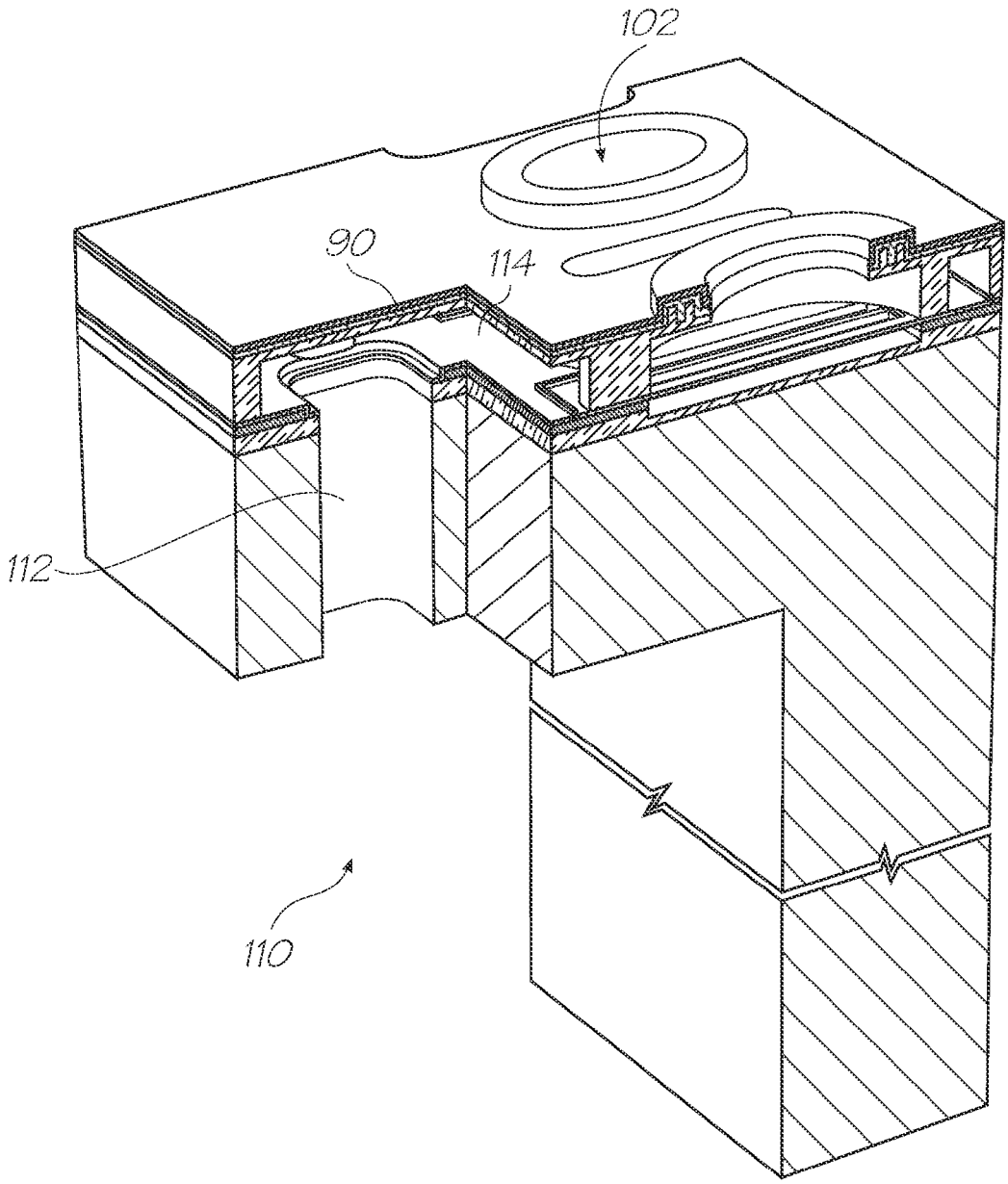
FIG. 16 is a perspective view of the nozzle assembly shown in FIG. 15.

Therefore, it was concluded that a wet etch under basic conditions (i.e. pH>7) to remove the aluminum film 90 was fully compatible with the EPI-treatment. Thus, a suitable process for providing printhead assemblies having hydrophilic ink pathways and a hydrophobic ink ejection face comprises the steps of:

(i) assembling the printhead assembly 130 using the aluminum-protected printhead ICs shown in FIGS. 15 and 16;

(ii) exposing the printhead assembly 130 to an $O_2$ plasma and treating ink pathways with an EPI solution; and (iii) removing the aluminum film 90 to reveal the hydrophobic polymer 80 disposed on the nozzle plate 115 of the printhead.

Of course, variants of this process in accordance with the first, second and third embodiments described above are within the ambit of the present invention.

Although the invention has been described herein with reference to a number of specific embodiments, it will be appreciated by those skilled in the art that the invention is not limited only to the disclosed embodiments, and that these embodiments described a best-mode/preferred embodiment, whereas the invention may be embodied in other forms encompassed within the scope of this invention.

The invention claimed is:

1. A method of providing a printhead assembly having a hydrophilic ink pathway and a hydrophobic ink ejection face, the method comprising the steps of:

providing a printhead assembly having an inkjet printhead attached to an ink supply manifold, the inkjet printhead comprising a nozzle plate having a hydrophobic coating and a protective metal film disposed on the hydrophobic coating;

treating surfaces of an ink pathway in the printhead assembly with a solution comprising an alkoxylated polyethyleneimine;

drying the surfaces; and removing the protective metal film so as to reveal the hydrophobic coating, thereby providing the printhead assembly having the hydrophilic ink pathway and the hydrophobic ink ejection face, wherein said method further comprises the step of:

plasma activating the surfaces of the ink pathway before treating the surfaces with the solution comprising the alkoxylated polyethyleneimine.

2. The method of claim 1, wherein the protective metal film is an aluminium film.

3. The method of claim 1, wherein the hydrophobic coating comprises a polymerized siloxane.

4. The method of claim 1, wherein the surfaces are plasma activated using an oxygen plasma.

5. The method of claim 1, wherein the surfaces of the ink pathway are comprised of at least one of: silicon, silicon oxide, silicon nitride and one or more polymers.

6. The method of claim 5, wherein said one or more polymers are selected from the group consisting of: liquid crystal polymers, polyimides, polysulfones, epoxy resins, polyolefins and polyesters.

7. The method of claim 1, wherein the printhead is comprised of one or more printhead integrated circuits, each printhead integrated circuit comprising nozzle chambers and ink supply channels defining at least part of the ink pathway.

8. The method of claim 1, wherein said drying surfaces comprises passing air through the ink pathway.

9. The method of claim 1, further comprising the step of: baking the printhead assembly.

10. The method of claim 9, wherein said drying the surfaces includes said baking the printhead assembly.

11. The method of claim 1, wherein the removing the protective metal film uses a basic etchant solution.

12. The method of claim 1, wherein the removing the protective metal film uses a solution of a quaternary ammonium hydroxide.

13. The method of claim 12, wherein said removing the protective metal film uses a solution of a tetra(C1-6 alkyl) ammonium hydroxide.

14. The method of claim 1, wherein the alkoxylated polyethyleneimine is a polyethyleneimine having one or more primary and/or secondary amine groups functionalized with a moiety of formula (A):

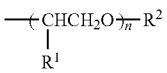

(A)

wherein:

R1 is selected from the group consisting of: H and $C_{1-6}$ alkyl;

R2 is selected from the group consisting of: H, $C_{1-6}$ alkyl and —C(O)—$C_{1-6}$ alkyl; and n is an integer from 1 to 50.

15. The method of claim 14, wherein the alkoxylated polyethyleneimine is from 1 to 99% alkoxylated and has a molecular weight of from 300 to 1,000,000.

16. The method of claim 14, wherein said alkoxylated polyethyleneimine is selected from the group consisting of: ethoxylated polyethyleneimine and propoxylated polyethyleneimine.

17. The method of claim 1, wherein the solution further comprises one or more components selected from the group consisting of: $C_{1-6}$ alcohol, ($C_{2-6}$ alkylene) glycol, poly($C_{2-6}$ alkylene) glycol, water and at least one surfactant.

18. A method of providing an inkjet printhead having a hydrophilic ink pathway and a hydrophobic ink ejection face, the method comprising the steps of:

providing the inkjet printhead comprising a nozzle plate having a hydrophobic coating and a protective metal film disposed on the hydrophobic coating;

treating the surfaces of an ink pathway in the inkjet printhead with a solution comprising an alkoxylated polyethyleneimine;

drying the surfaces; and removing the protective metal film so as to reveal the hydrophobic coating, thereby providing the inkjet printhead having the hydrophilic ink pathway and the hydrophobic ink ejection face, wherein said method further comprises the step of:

plasma activating the surfaces of the ink pathway before treating the surfaces with the solution comprising the alkoxylated polyethyleneimine.

* * * * *